US005136961A

United States Patent [19]

Follett

[11] Patent Number: 5,136,961

[45] Date of Patent: Aug. 11, 1992

[54] HYDROPLANING HYDROFOIL/AIRFOIL STRUCTURES AND AMPHIBIOUS AND AQUATIC CRAFT

[76] Inventor: Harold E. Follett, 100 Reamer Ave. West, Wilmington, Del. 19804

[21] Appl. No.: 454,714

[22] Filed: Dec. 21, 1989

[51] Int. Cl.[5] ..... B63B 1/24

[52] U.S. Cl. ..... 114/274; 114/39.1; 114/61

[58] Field of Search ..... 114/39.1, 61, 271-292

[56] References Cited

U.S. PATENT DOCUMENTS

| | | | |
|---|---|---|---|
| 2,647,709 | 8/1953 | Doolittle et al. | 244/108 |
| 2,720,367 | 10/1955 | Doolittle | 244/1 |
| 2,751,612 | 6/1956 | Shepard . | |
| 2,795,202 | 6/1957 | Hook | 114/276 |
| 2,821,948 | 2/1958 | Harkson . | |
| 2,858,788 | 11/1958 | Lyman | 114/39.1 |
| 2,890,672 | 6/1959 | Boericke, Jr. | 114/274 |
| 2,972,974 | 2/1961 | Follett | 114/281 |
| 3,112,725 | 12/1963 | Malrose | 114/39.1 |
| 3,121,890 | 2/1964 | Rumsey, Jr. . | |
| 3,157,146 | 11/1964 | Billig . | |
| 3,162,166 | 12/1964 | Handler . | |
| 3,164,119 | 1/1965 | Emmanuel et al. . | |
| 3,182,341 | 5/1965 | Rieffle | 114/281 |
| 3,429,287 | 2/1969 | Uram . | |
| 3,498,247 | 3/1970 | Handler | 114/274 |
| 3,547,063 | 12/1970 | Follett | 114/274 |
| 3,802,366 | 4/1974 | Mankawich | 114/39.1 |
| 4,049,287 | 9/1977 | Dudouyt | 280/213 |
| 4,164,909 | 8/1979 | Ballard | 114/282 |
| 4,524,709 | 6/1985 | McKenna | 114/39.1 |
| 4,606,291 | 8/1986 | Hoppe | 114/274 |
| 4,635,577 | 1/1987 | Palmquist | 114/39.1 |

OTHER PUBLICATIONS

Popular Mechanics, Jun. 1983, "Now Your Sailboard Can Fly", pp. 72-74.

Sail, Apr. 1988, "Tapping the Multihull Potential", p. 71.

Sail, Jan. 1985, "Seaflier", p. 89.

Sail, Nov. 1987, "A New-Fangled Foiler", p. 62.

Popular Science, Feb. 1972, "A Storm of New Ideas from Sail-Power", p. 104.

Aviation Week, Feb. 1988, "X-29 Completes Performance etc.".

News release, Apr. 21, 1988, B-2 Flying Wing.

*Primary Examiner*—Jesûs D. Sotelo

*Attorney, Agent, or Firm*—Robert W. Black

[57] ABSTRACT

A hydroplaning hydrofoil and airfoil planing or flying wing structure is disclosed based on the concept of forward-swept planes or planar surfaces having swept-back fore foil sections and forward-swept aft foil sections upon which the hydrofoil/airfoil structure optionally supports itself and planes on or through a fluid preferably either water or air. Also disclosed are aquatic structures or watercraft to which the hydroplaning hydrofoil/airfoil structures are optionally attached. In addition, light weight amphibious structures are disclosed; preferably these structures are sail, engine, or electric motor powered craft to which the hydroplaning hydrofoil/airfoil structures are optionally attached.

150 Claims, 10 Drawing Sheets

60°
30°
45°
1°-35°

FIG. 30
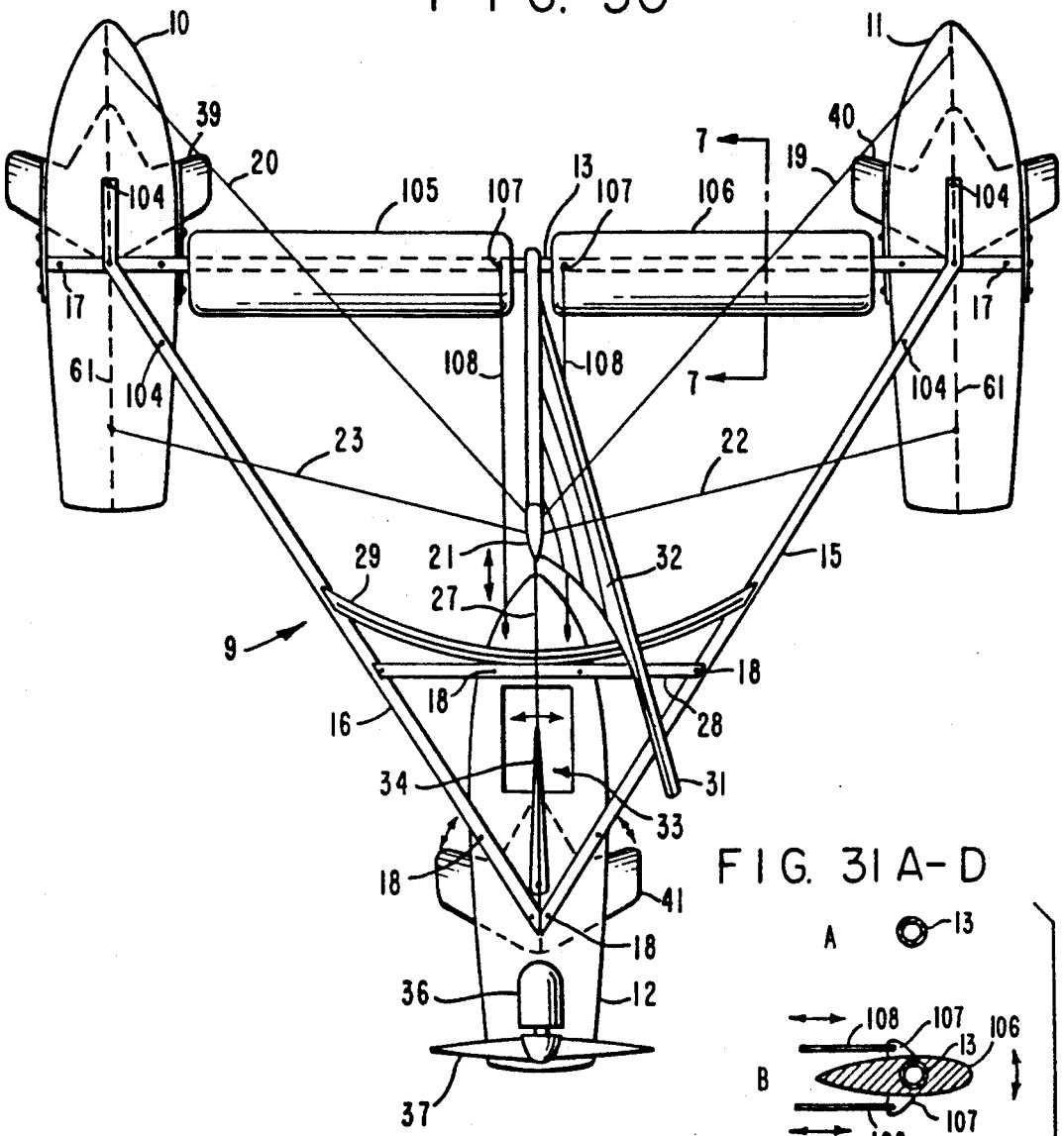
FIG. 31A-D
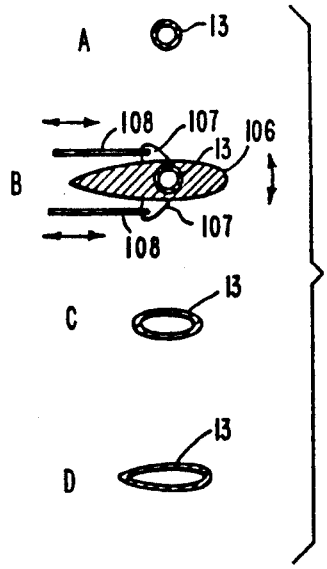
FIG. 30A
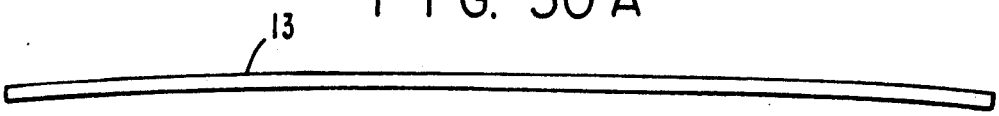

HYDROPLANING HYDROFOIL/AIRFOIL STRUCTURES AND AMPHIBIOUS AND AQUATIC CRAFT

FIELD OF INVENTION

This invention relates to hydroplaning hydrofoils, airfoil structures or flying wing structures, lightweight amphibious structures and aquatic crafts and more particularly to hydroplaning hydrofoil/airfoil structures that plane on or through a fluid preferably either water or air which are optionally self-supporting or attached to aquatic structures or watercraft, particularly sailing craft.

BACKGROUND

Man continues to dream of going faster and faster. On water and through air, this is evidenced by the changing designs of fresh water and ocean racing watercraft and the stealth aircraft flying wings. Whatever the design, there is a continuing search for new hydrofoils, and airfoil or flying wing structures which will achieve faster speeds on water and through air. U.S. Pat. No. 4,635,577, granted to Palmquist on Jan. 13, 1987, is an example of one attempt to provide a hydroplaning hydrofoil and air wing supported sailing craft.

SUMMARY OF THE INVENTION

According to the present invention there is provided a hydroplaning hydrofoil and airfoil structure for planing on or through a fluid preferably either water or air comprising in its broadest aspects for water as exemplified in FIGS. 21–23: at least two foils each having an underside plane or substantially planar-bottom surface, two of said planar-bottom surfaces intersecting along a fore and aft longitudinal bottom centerline forming a left side foil substantially planar-bottom surface and a right side foil substantially planar-bottom surface, each foil substantially planar-bottom surface ascending transversely from said longitudinal bottom centerline to form a dihedral angle in the range of about 2° to 50° up from a transverse horizontal line and having a positive angle of attack of about 1° to 16° in the direction of motion from a horizontal longitudinal line up to said longitudinal bottom centerline, each said left and right foil substantially planar-bottom surface having a forward swept leading edge ranging from about 0° transversely from said longitudinal bottom centerline to about 75° forward sweep, and each said left and right foil substantially planar-bottom surface having a fore foil planar-bottom section and an aft foil planar-bottom section intersecting along said fore and aft longitudinal bottom centerline, each fore foil planar-bottom section having a swept-back leading edge ranging from about 0° transversely from said longitudinal bottom centerline to about 80° swept-back, and each aft foil planar-bottom section having a forward swept trailing edge ranging from about 0° transversely from said longitudinal bottom centerline to about 75° forward swept, and optional means for attaching said structure to an aquatic structure or watercraft. A preferred and most preferred hydroplaning hydrofoil/airfoil structure that planes on a fluid surface of water, surprisingly, planes or glides through air as an airfoil structure. Such an airfoil structure, as disclosed in the title of this invention, will be more fully described in FIGS. 22, 24–29, and 37–41.

Also provided is an aquatic structure or watercraft comprising: at least one buoyant hull structure, a hydroplaning hydrofoil/airfoil structure described above attached to the underside of each hull with the fore and aft longitudinal top foil and bottom centerlines of said hydroplaning hydrofoil/airfoil structure under the longitudinal axis of each hull, and propulsion means mounted on said watercraft for powering the watercraft.

Additionally provided is an amphibious buoyant structure comprising: a port bow hull, a starboard bow hull, and a stern hull positioned aft along a longitudinal centerline between the port bow hull and the starboard bow hull; at least one crossbeam connector rigidly affixed to the port and starboard bow hulls; at least one fore and aft extending port connector and at least one fore and aft extending starboard connector, such connectors rigidly affixed to the stern hull and to the port and starboard bow hulls; propulsion means mounted on said structure for powering the structure; means for controlling the direction of movement of the structure; and supporting means attached to the underside of each hull for supporting and moving the structure over land, water, ice, or snow.

BRIEF DESCRIPTION OF THE DRAWINGS

FIG. 30 is an overall top view of a watercraft three hull amphibious tube structure, which is a modification of the one shown in FIGS. 1, 2 and 3, with pivotable wings and hydroplaning hydrofoil/airfoil structures and with sail, engine or electric motor propulsion;

FIG. 30A is an arched crossbeam tube connector;

FIGS. 31A-D are enlarged cross-sectional views of four connector shapes, the one in FIG. 31B shown in cross-section along line 7—7 of FIG. 30 showing the starboard pivotable wing for creating a negative or positive air lift;

DETAILED DESCRIPTION OF THE INVENTION

Figure 1:
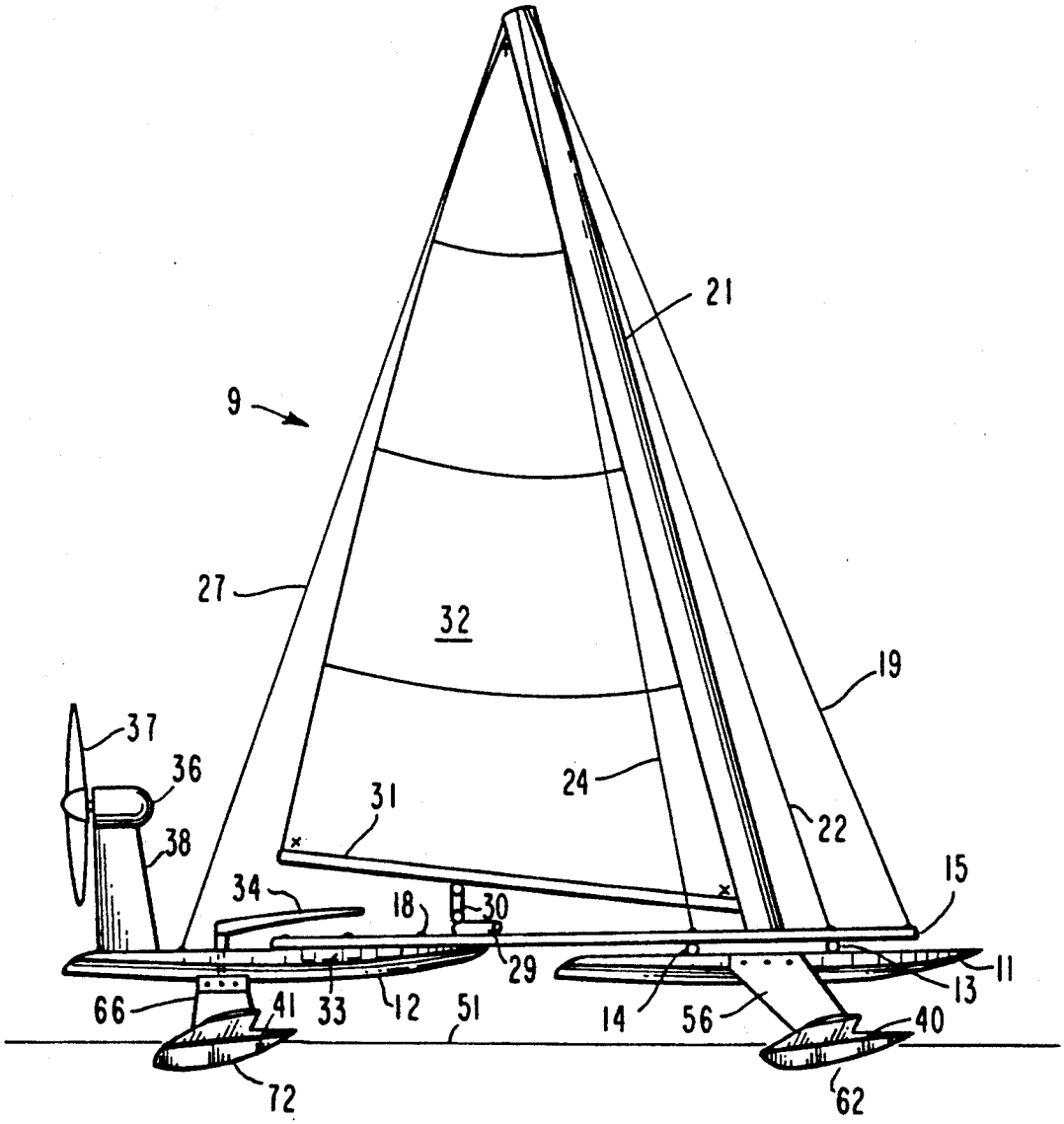
FIG. 1 is an overall side view of a watercraft three hull amphibious tube structure hydroplaning with three supporting hydroplaning hydrofoil/airfoil structures with sail, engine, or electric motor propulsion.

Reference is made to FIGS. 1-9, which show a preferred embodiment of a watercraft 9 constructed with a three hull amphibious tube structure component and a preferred hydroplaning hydrofoil/airfoil structure component. A three hull amphibious tube structure comprises a port bow hull 10, a starboard bow hull 11 and a stern hull 12 forming a triangular configuration all rigidly connected. The bow hulls are rigidly attached via bolts or screws 17 by crossbeam tube connectors 13 and 14, and stern hull 12 is rigidly attached to bow hulls 10 and 11 by a fore and aft extending starboard tube connector 15 and a fore and aft extending port tube connector 16. Stern hull 12 is positioned aft at a distance along a longitudinal centerline between port bow hull 10 and starboard bow hull 11 so that the three hulls are approximately equidistant; however, the stern hull 12 may be extended further aft or forward so as to form an isosceles triangle three point hull structure.

The forward extending starboard and port tube connectors 15 and 16 are attached directly to stern hull 12 by bolts or screws 18 and to crossbeam tube connectors 13 and 14 by bolts or screws 26, and each are angled out from the stern hull 12 at about 16° to the starboard and about 16° to the port but may extend straight forward at 0° or angle out to about 45° measured from the longitudinal centerline of watercraft 9. Each fore and aft extending starboard and port tube connector 15 and 16 extends forward to a point in front of the most forward crossbeam tube connector 13 to provide a connection and support for two forestays 19 and 20 leading to and attached to the upper part of sailing rig mast 21. Shrouds 22, 24, and 23, 25 of the sailing rig are connected to the starboard and port fore and aft extending tube connectors 15 and 16 respectively. They also lead to and are attached to the upper part of mast 21. Backstay 27 is attached to stern hull 12 and leads to and is attached to the upper part of mast 21. Mast 21 is attached to the three hull tube connector structure by means of an optional mast step tube 35 (or a brace) positioned along the longitudinal fore and aft centerline of watercraft 9 and attached at each end to the two crossbeam tube connectors 13 and 14.

Figure 3:
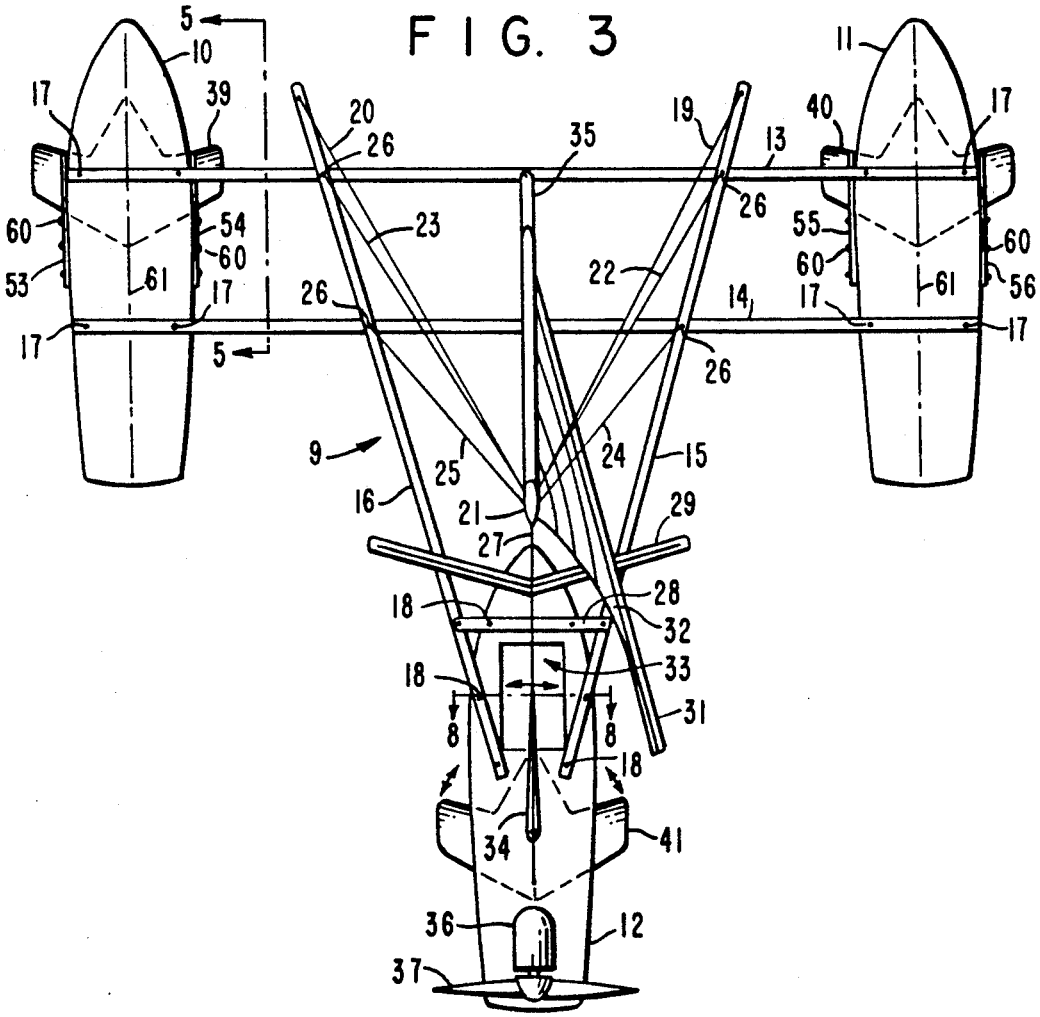
FIG. 3 is a top view of the structure shown in FIG. 1.

A stern hull crossbeam tube or brace 28 (optional) and a removably mounted traveler connector tube or support 29 are positioned in the fore section of stern hull 12 and are attached to the deck of stern hull 12 and to the two fore and aft extending tube connectors 15 and 16 for extra support. Traveler connector tube or support 29 controls mainsheet 30 shown in FIG. 1 attached to boom 31. In FIG. 3, traveler connector tube or support 29 is bent or angled forward from a transverse position on each side of watercraft 9 longitudinal centerline; however, it may be positioned across in a straight transverse position or curved forward to accommodate mainsheet 30, sail 32 and boom 31 as shown in FIGS. 30 and 32.

A cockpit 33 and steering tiller 34 (showing direction of motion) are also positioned on stern hull 12.

Figure 32:
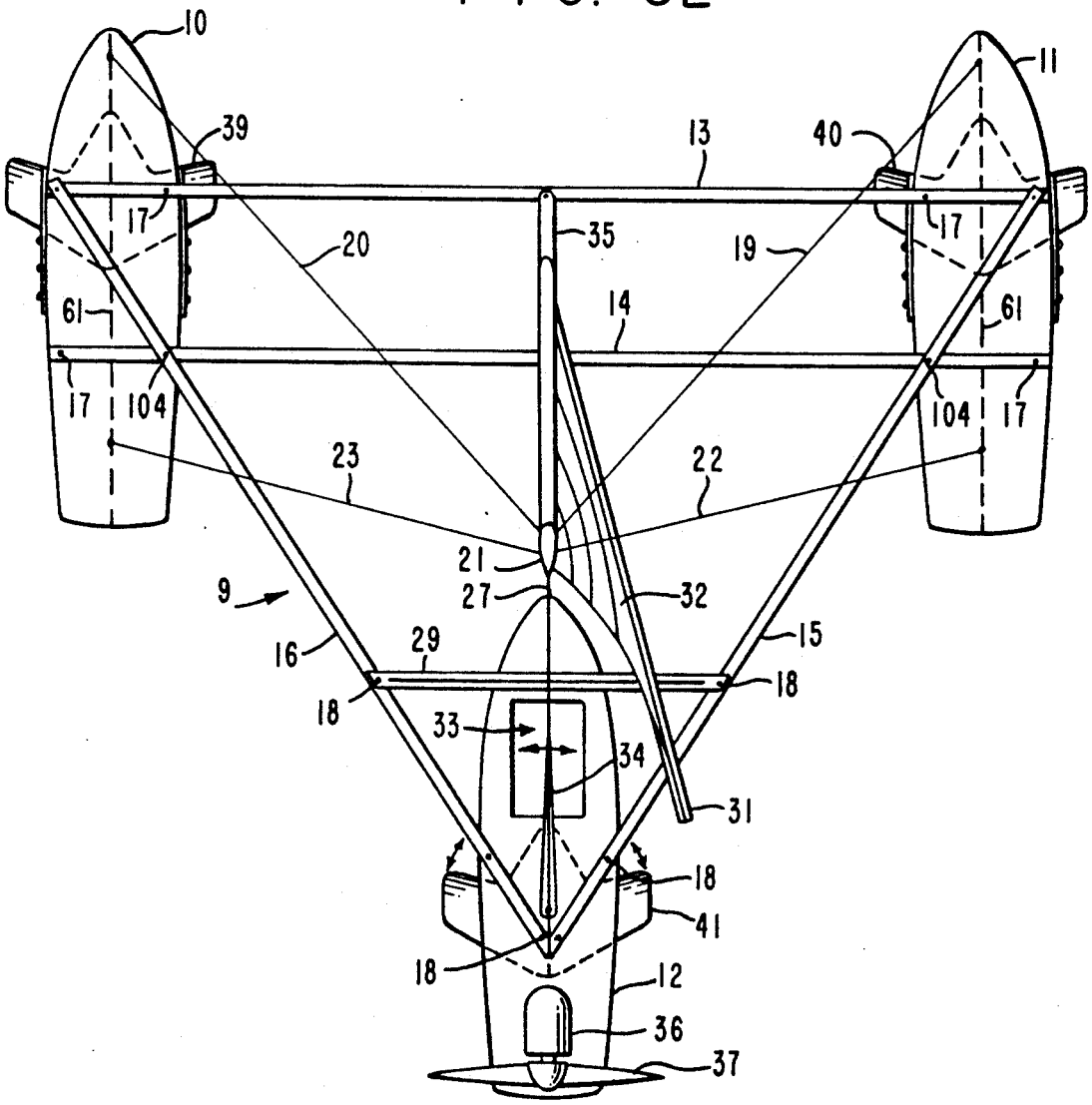
FIG. 32 is an overall top view of a watercraft three hull amphibious tube structure, which is a modification of those shown in FIGS. 1-3 and 30, with three supporting hydroplaning hydrofoil/airfoil structures with sail, engine or electric motor propulsion.

FIGS. 30 and 32 show additional three hull amphibious tube structure components. The sail rigging to support the mast, sail and boom can be attached anywhere on all three hulls and on the traveler connector tube or support, preferably as shown.

The idea of a watercraft having three hulls spread far apart and connected only with tubes or connectors offers extremely light weight and stability; ideally matched for sailing on hydroplaning hydrofoil/airfoils. Materials of construction for all structures provided in this invention can be any materials; preferably they are buoyant and strong and can range from light weight materials and metals to high-tech composite materials.

The connectors or tubes shown in all hull connections are not limited to straight connectors or tubes. For example, FIG. 30A shows crossbeam tube connector 13 arched or angled up slightly to a high point at the watercraft longitudinal centerline to give better wave clearance, and for optional cable, rope, or rod reinforcements. Secondary tubes, rods, and braces can also be added for additional strength. The bolts and screws used for connecting the three hulls and tube connectors are two of several fastening options which include fastpins, hose clamps, pipe clamps, cast or molded fittings, tube or pipe welding, and other fastening means known to those in the art.

Figure 2:
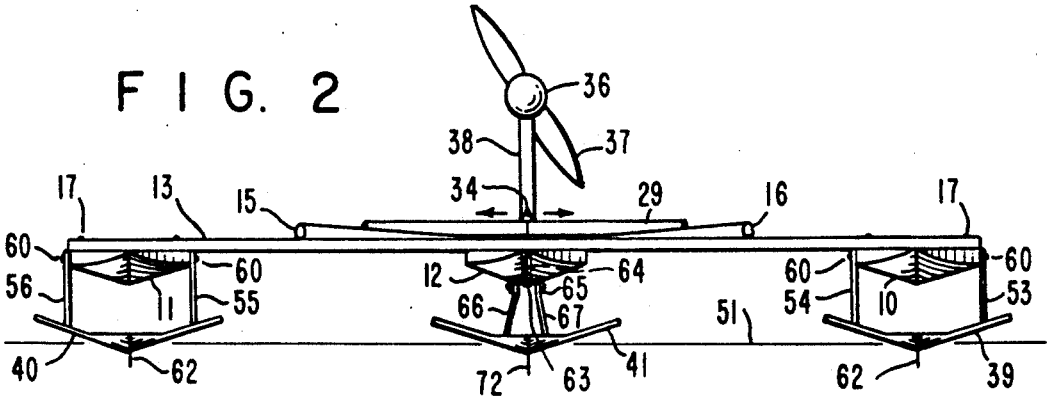
FIG. 2 is a front view of the structure shown in FIG. 1 with engine or electric motor propulsion.

As shown in FIGS. 1 and 3, an engine or electric motor 36 drives propeller 37 as an auxiliary propulsion means for watercraft 9. In FIG. 2, the engine or electric motor driven propeller is the sole power means. The engine or electric motor 36 is attached to stern hull 12 by a stanchion support 38. It is readily apparent that other propulsion or power means can be used depending upon the type of watercraft or aquatic structure, the size, and the market. For example, the propulsion or power means can be an engine driven air or water propeller, an electric motor driven air or water propeller, human-powered pedal-driven air or water propeller, human-powered paddle wheels or rowing with oars, an engine driven waterjet or air jet drive, rubber band driven air or water propeller, a wind driven sailing rig, a wind driven wing sail, or a tow line affixed to a watercraft or affixed directly to the hydroplaning hydrofoil/airfoil structure.

As shown in FIGS. 1-9, three hydroplaning hydrofoil/airfoil structures 39, 40 and 41 are attached to the underside of hulls 10, 11 and 12 respectively of the three hull amphibious tube structure to provide supporting means to move the structure over water or a fluid (as shown) including ice level 42 or snow. Each hydroplaning hydrofoil/airfoil structure is attached to each hull so that the longitudinal centerlines 61 of each hull are coplanar with the top foil and bottom centerlines 75 and 76 of each hydroplaning hydrofoil/airfoil structure. In FIGS. 1 and 2, the hydroplaning hydrofoil/airfoil structures are shown supporting the three hull watercraft 9 above water or fluid level 51, hydroplaning at high speed with very little wetted surface.

Details of a most preferred hydroplaning hydrofoil/airfoil structure as attached to a watercraft are shown in FIGS. 4-9, 27, 28 and 29. Various designs of the hydroplaning hydrofoil/airfoil structure in its broadest and preferred aspects, including reverse direction versatility, are shown in FIGS. 10-26.

Figure 4:
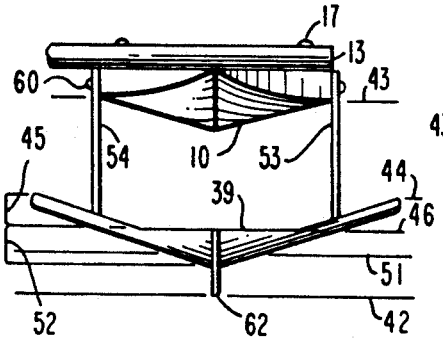
FIG. 4 is a fragmentary front view of FIG. 2 showing a hydroplaning hydrofoil/airfoil structure and the port bow hull.
Figure 5:
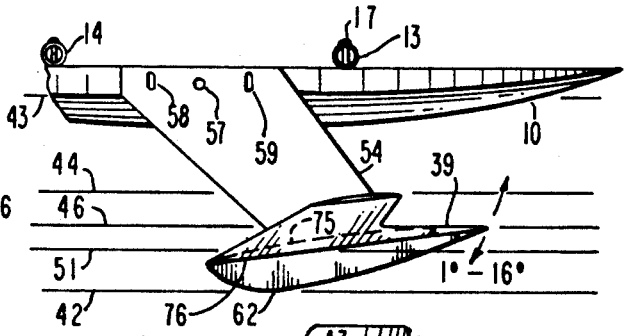
FIG. 5 is a fragmentary side view of the port bow hull and the hydroplaning hydrofoil/airfoil structure shown in FIGS. 2, 3 and 4 shown along line 5—5 of FIG. 3.

As shown in FIGS. 4 and 5 (along line 5—5 of FIG. 3), accelerating hydroplaning hydrofoil/airfoil structure 39 is shown lifting port bow hull 10 from static water or fluid level 43 to initial water or fluid level 44 at low speed. As speed increases through the hydrofoil/airfoil support range 45 to water or fluid level 46 at medium speed, the left side and right side foil top surfaces 47 and 48 (shown more clearly in FIG. 6) are lifted completely above the water or fluid providing airfoil lift; and, amazingly as hydroplaning starts, when the two left and right fore foil top sections 49 and 50 surface above water or fluid level 46 at medium speed, drag is reduced as hydroplaning continues from water or fluid level 46 at medium speed to water or fluid level 51 at high speed as shown by wetted planar-bottom surfaces in FIGS. 4-6. The hydroplaning support range is shown by 52 in FIG. 4. The exact speed and the water or fluid levels shown will vary according to the type of watercraft or aquatic structure, its displacement in water or fluid, the propulsion or power means selected, wind, water or fluid conditions, the buoyancy of the hydroplaning hydrofoil/airfoil structures, the angle of attack (or angle of incidence), and the size of the lifting planar-bottom surface areas of the hydroplaning hydrofoil/airfoil structures.

Each hydroplaning hydrofoil/airfoil structure 39 and 40 is attached to hulls 10 and 11 respectively by two pivotal struts 53 and 54, and 55 and 56 respectively. As shown more fully in FIG. 5, each strut has a pivot hole 57 and two vertical elongated adjusting slots 58 and 59 near the top of each strut for attaching the strut to each side of the hull with bolts or screws 60 (removed in this FIG. 5 for clarity). This enables each hydroplaning hydrofoil/airfoil structure 39 and 40 either to be removed or to be reversed 180° and still run as a hydroplaning hydrofoil/airfoil structure. Any pivot or detachment means can be used in place of bolts or screws 60 through the struts. For example, various gear, pulley, rope, and cable connections can extend strut pivotal control back to cockpit 33 and operate by hand, winch, radio or computer controlled servos or a joy stick as in an airplane. Pivot hole 57, in association with slots 58 and 59, will swing and adjust hydroplaning hydrofoil/airfoil structures 39 and 40 so as to adjust and control the angle of attack from about 1° to 16° in the direction of motion from a horizontal longitudinal line up to the longitudinal bottom centerline 76, preferably about 2° to 15°, or at an average of about 7° on water or fluid as shown in FIG. 5.

Fins 62 are removably or reversibly attached to the underside of each hydroplaning hydrofoil/airfoil structure 39 and 40 along the longitudinal bottom centerline 76 or parallel to the longitudinal bottom centerline (not shown).

Figure 7:
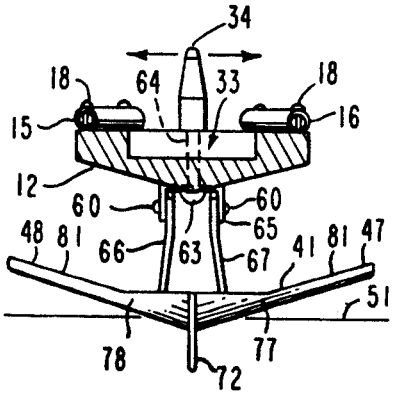
FIG. 7 is a front view of a hydroplaning hydrofoil/airfoil structure and a cross-sectional front view of the stern hull shown along line 8—8 of FIG. 3.
Figure 9:
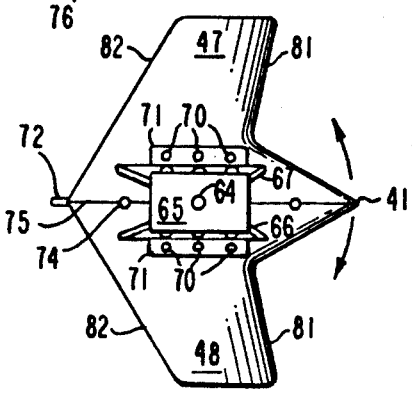
FIG. 9 is a top view of the stern hydroplaning hydrofoil/airfoil structure shown in FIGS. 7 and 8 removed from the stern hull.

FIGS. 7 (along line 8—8 of FIG. 3) and 8 show hydroplaning hydrofoil/airfoil structure 41 attached to stern hull 12 showing means for rotating the structure to give directional control to the watercraft 9 (shown by arrows in FIGS. 3 and 9). Steering tiller 34 is attached by means of a tiller shaft 63, which extends through shaft hole 64 in stern hull 12, to strut bracket 65. Strut bracket 65 is attached to struts 66 and 67 by bolts or screws 60. As with struts 53-56, each stern hull strut 66 and 67 has a pivot hole 57 and two adjusting slots 58 and 59. Steering tiller 34 rotates the entire hydroplaning hydrofoil/airfoil structure 41 and rudder 72 for directional control of the watercraft.

Figure 6:
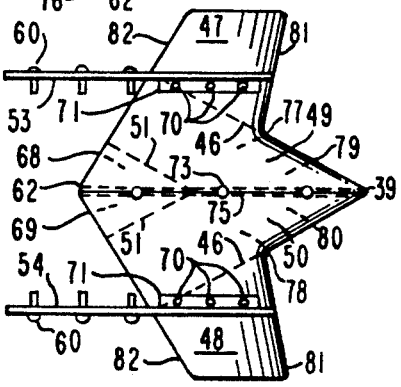
FIG. 6 is a top view of the hydroplaning hydrofoil/airfoil structure shown in FIGS. 4 and 5 removed from the port bow hull.

As shown in FIGS. 2, 6 and 9, each strut 53-56, 66 and 67 is attached to the left side foil top surface 47 or the right side foil top surface 48 of each hydroplaning hydrofoil/airfoil structure 39, 40 and 41 by bolts, screws or rivets 70 through a strut flange 71. Any attachment means can be used in place of bolts, screws or rivets 70. Reversible fins 62 (shown with a dotted line in FIG. 6), and reversible rudder 72 are attached to the underside of the hydroplaning hydrofoil/airfoil structures by bolts or screws 73 and 74 respectively.

Figures 10, 11, 12, 13, 13A, 14, 14A, 15, 16, 16A, 16B:
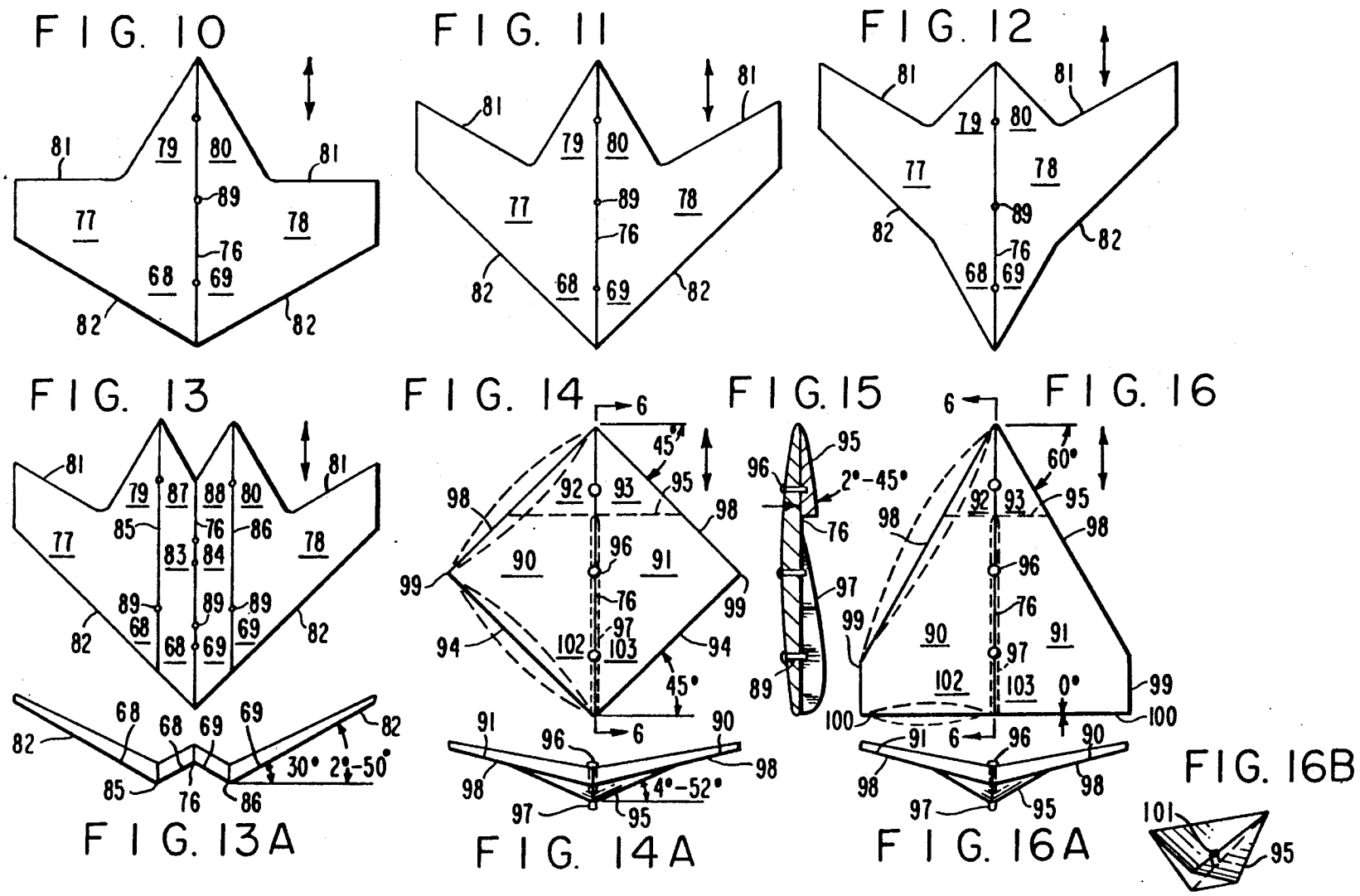
FIGS. 10 through 20E show various hydroplaning hydrofoil/airfoil structures within the scope of the present invention in see through top views of the bottom plane or planar-bottom surfaces, front or back views, and cross-sectional or side views, some showing the optional, removable step, rudder and fin, with the arrows indicating a reversible direction of motion.

To more fully understand the water or fluid levels, speed references and the hydroplaning hydrofoil/airfoil structures shown in FIGS. 4-9, each hydroplaning hydrofoil/airfoil structure has a left side foil top surface 47 and a right side foil top surface 48 converging to form a full length fore and aft longitudinal top foil centerline 75, and a bottom centerline 76 formed by two converging full length foil planar-bottom surfaces, a left side foil planar-bottom surface 77 and a right side foil planar-bottom surface 78. Foil planar-bottom surfaces 77 and 78 ascend transversely from the longitudinal bottom centerline 76 to form a dihedral angle of about 18° as shown or in the range of about 2° to 50° broadly or preferably also in the range of about 2° to 50° or most preferably in the range of about 2° to 30°. The 18° dihedral angle shown is the angle of inclination of the left and right foil planar-bottom surfaces 77 and 78 measured in compass degrees up from a transverse horizontal line intersecting the longitudinal bottom centerline 76. FIG. 13A shows a dihedral range of about 2° to 50°.

As can be seen, having two converging foil planar-bottom surfaces with ascending dihedral angles provides a smoother ride in rough water than a flat bottom surface, and substantially reduces the wetted surface transversely when hydroplaning at water or fluid level 46 at medium speed, and water or fluid level 51 at high speed. Each left side foil planar-bottom surface 77 and right side foil planar-bottom surface 78 has a fore foil planar-bottom section (79 and 80 respectively) which is a forward extension along the longitudinal bottom centerline 76. Each fore foil planar-bottom section has a swept-back leading edge of 60° as shown or one ranging from about 0° transversely from the longitudinal bottom centerline 76 to about 80° swept-back broadly or preferably ranging from about 30° to about 75° swept-back or most preferably ranging from about 45° to about 70° swept-back. As used herein, all forward swept and swept-back leading and trailing edges are measured in compass degrees transversely to the longitudinal bottom centerline 76 as shown with arrows and compass degrees in FIGS. 14, 16, 18, 19, and 21 through 29.

Figure 22:
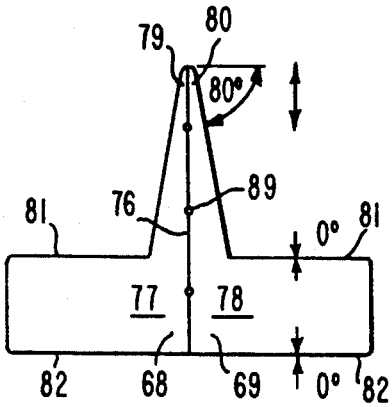
Figure 23:
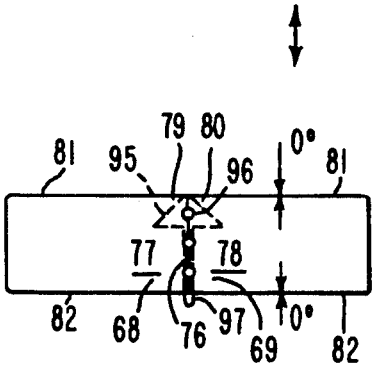
Figure 25:
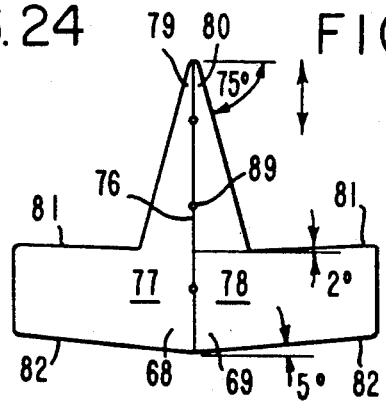
Figure 26:
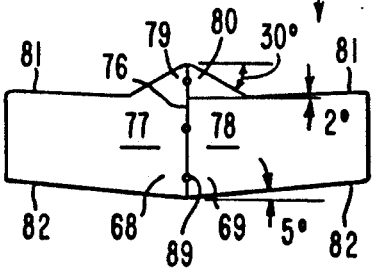

The length of each fore foil planar-bottom section 79 and 80, as shown in FIGS. 5 and 6, is about the first one-third of the entire length or chord of the hydroplaning hydrofoil/airfoil structure along longitudinal top foil and bottom centerlines 75 and 76; however, the length of the fore foil planar-bottom sections in their broadest aspects can range from 0° shown in FIG. 23 or in the preferred length of about one-fourth of the chord length shown in FIG. 26 to about the first two-thirds to three-fourths of the chord length along top foil and bottom centerlines 75 and 76 shown in FIGS. 22 and 25.

Each left side foil planar-bottom surface 77 and right side foil planar-bottom surface 78 has an aft foil planar-bottom section which is a backward or aft extension along the longitudinal bottom centerline 76. As shown in FIGS. 4–6, each aft foil planar-bottom section 68 and 69 at high speed water or fluid level 51 has a forward swept trailing edge 82 of 30° or one ranging broadly from about 0° transversely from longitudinal bottom centerline 76 to about 75° forward swept or preferably ranging from about 5° to about 60° forward swept or most preferably from about 10° to about 45° forward swept. The trailing edge ranges are described more fully in FIGS. 21–29.

The length of each aft foil planar-bottom section 68 and 69 is about the last one-fourth to about one-third of the entire chord length of the hydroplaning hydrofoil-/airfoil structure along longitudinal bottom centerline 76 at high speed water or fluid level 51 as shown in FIGS. 5 and 6. The aft foil planar-bottom sections 68 and 69 vary in wetted surface area and length with speed and load; however, it is the section of the hydroplaning hydrofoil/airfoil structure which provides for high speed hydroplaning.

The left side and right side foil planar-bottom surfaces 77 and 78 have left wing and right wing forward swept leading edges 81 of 12° as shown in FIGS. 1 through 9; however, left and right leading edges 81 can be forward swept in the broad range of about 0° transversely from longitudinal bottom centerline 76 to about 75° forward sweep, or preferably in the range of about 2° to about 60° forward sweep, or most preferably in the range of about 4° to about 45° forward sweep. Foil planar-bottom surfaces 77 and 78 have forward swept trailing edges coextensive with aft foil planar-bottom section trailing edge 82, i.e., forward swept 30° as shown in FIGS. 1 through 9, but with forward swept ranges as described above and in FIGS. 21 through 29.

Relative to performance advantages, it should be added that incorporating hydroplaning hydrofoil/airfoil forward swept left wing and right wing planar-bottom surfaces with transverse ascending dihedral angles and a positive angle of attack in the direction of motion with leading edges and trailing edges that sweep forward, is not just an eye-catching idea to be different, but it is very functional in that the forward swept leading edges actually lift above the water or fluid surface providing airfoil lift through air and to facilitate hydroplaning of the fore foil and aft foil planar-bottom sections to achieve wave clearance sooner during acceleration at medium speed, as compared to swept-back leading edges that do not lift above the water or fluid as soon during acceleration, or lift above waves with as much clearance. The end result is achieved when the forward swept aft foil planar-bottom sections 68 and 69 hydroplane at high speed water or fluid level 51. This enables a watercraft or aquatic structure to perform at high speeds, touching the water or fluid surface with extremely little drag and wetted bottom surface with both hydroplane and airfoil lift, ideal for smooth water and skip planing over wave crests and through air.

Figures 17, 17A, 17B, 17C, 17D, 17E, 17F, 18, 19, 20, 20A, 20B, 20C, 20D, 20E:
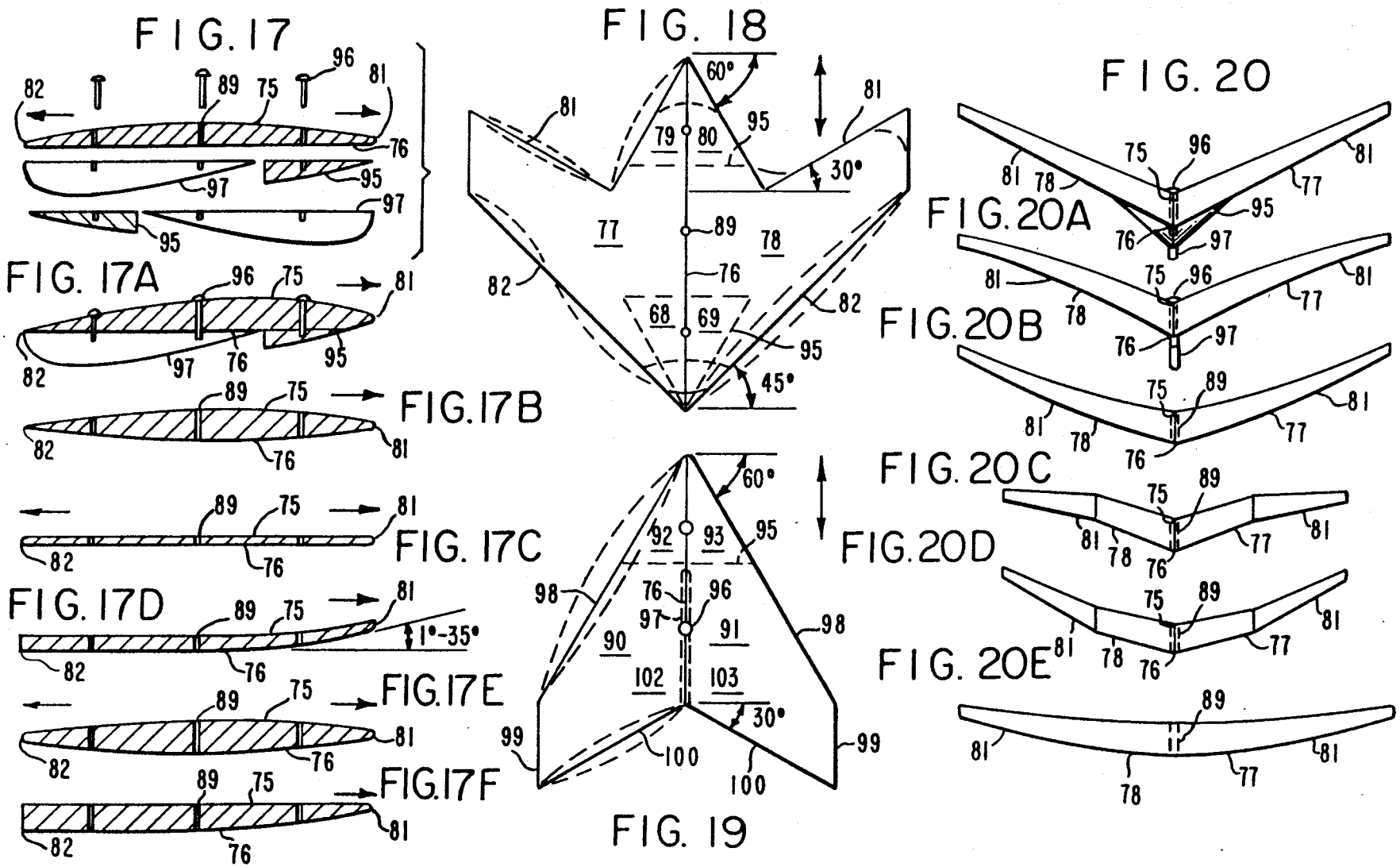

FIGS. 10 through 20E will describe various configurations of the hydroplaning hydrofoil/airfoil structures of this invention in see through foil top views of the bottom plane or planar-bottom surfaces, cross-sectional views, and front or back views. Where possible, the reference numerals used in FIGS. 1–9 will be used for consistency and ease of understanding. FIGS. 6, 10, 11, 12, 13 and 18 structures are for planing on a fluid surface of water and for planing or flying through a fluid preferably air. FIGS. 14, 16 and 19 structures are for planing on a fluid surface of water.

FIG. 10 shows a see through top view of the bottom plane or planar-bottom surfaces of a hydroplaning hydrofoil/airfoil structure having longitudinal bottom centerline 76 formed by two converging full length left side and right side foil planar-bottom surfaces 77 and 78 ascending transversely up from a horizontal line at about 2° to 50° predetermined dihedral angle (shown in FIG. 13A) to the left and right sides of the longitudinal bottom centerline 76, foil planar-bottom surfaces 77 and 78 having fore foil planar-bottom sections 79 and 80 respectively, swept-back with 60° leading edges. Foil planar-bottom surfaces 77 and 78 have transverse or about 0° leading edges 81 and 30° forward swept trailing edges 82 converging on the longitudinal bottom centerline 76 aft, forming aft foil planar-bottom sections 68 and 69.

Amphibious, and reverse direction performances are described with reference to the structure of FIG. 10, however these performances apply equally to the structures of the other drawings having a reversible arrow. Optional holes 89 along longitudinal bottom centerline 76 provide a means to bolt or screw a fin, or rudder to the underside of the structure along the longitudinal bottom centerline 76 as in FIG. 17 or parallel to the longitudinal bottom centerline such as along lines 85 and 89 in FIG. 13. Optional holes 89 along the bottom centerline 76 forming fore foil planar-bottom sections 79 and 80 also provide means to permanently or reversibly affix a step to the underside of the structure relative to the direction of motion of the structure. Such a step, described in more details in FIGS. 14A, 15, 16B, and 17, may be used for improved hydroplaning over rough water or fluid and running through snow. A detachable fin provides improved lateral plane through water or fluid and snow, and as a runner on ice as shown in FIGS. 4 and 5 by ice level 42. A detachable rudder provides improved steering control through water or fluid and snow, and as a steering runner on ice. It should be added that the step, fin or rudder may be removed in some water or fluid conditions, but fin and rudder control would be required in snow and as a runner on ice. The step, fin or rudder may also be made as permanent fixtures as described in FIG. 17.

By turning the hydroplaning hydrofoil/airfoil structure around fore and aft 180° and reversing the step, fin and rudder, the structure will operate in a reverse direction of motion, and a watercraft or aquatic structure will still perform as a hydroplaning hydrofoil/airfoil structure within the scope of this invention. FIGS. 17–17F show various forward motion and reversible hydroplaning hydrofoil/airfoil cross sections.

FIG. 11 shows a see through top view of the bottom plane or planar-bottom surfaces of a hydroplaning hydrofoil/airfoil structure having longitudinal bottom centerline 76 formed by two converging full length left side and right side foil planar-bottom surfaces 77 and 78 ascending transversely up from a horizontal line at about 2° to 50° predetermined dihedral angle (shown in FIG. 13A) to the left and right sides of the longitudinal bottom centerline 76, foil planar-bottom surfaces 77 and 78 having fore foil planar-bottom sections 79 and 80 respectively, swept-back with 60° leading edges. Foil planar-bottom surfaces 77 and 78 have 30° forward swept leading edges 81 and 45° forward swept trailing edges 82 converging on the longitudinal bottom centerline 76 aft, forming aft foil planar-bottom sections 68 and 69.

The optional holes 89 along the longitudinal bottom centerline 76 provide the same amphibious and reverse direction performances described in FIG. 10.

FIG. 12 shows a see through top view of the bottom plane or planar-bottom surfaces of a hydroplaning hydrofoil/airfoil structure having longitudinal bottom centerline 76 formed by two converging full length left side and right side foil planar-bottom surfaces 77 and 78 ascending transversely up from a horizontal line at about 2° to 50° predetermined dihedral angle (shown in FIG. 13A) to the left and right sides of the longitudinal bottom centerline 76, foil planar-bottom surfaces 77 and 78 having fore foil planar-bottom sections 79 and 80 respectively, swept-back with 60° leading edges. Foil planar-bottom surfaces 77 and 78 have 30° forward swept leading edges 81 and 45° and 60° forward swept angular trailing edges 82 converging on the longitudinal bottom centerline 76 aft; forming aft foil planar-bottom sections 68 and 69.

The optional holes 89 along the longitudinal bottom centerline 76 provide the same amphibious and reverse direction performances described in FIG. 10.

FIGS. 13 and 13A show a see through top view of four bottom planes or planar-bottom surfaces and a back view of a hydroplaning hydrofoil/airfoil structure having an elevated longitudinal bottom centerline 76 formed by two full length intersecting left and right foil planar-bottom surfaces 83 and 84 descending transversely down from a horizontal line at about 30° predetermined negative dihedral angle to a lower left longitudinal bottom line intersection 85 and a lower right longitudinal bottom line intersection 86 which intersect with an outer left full length foil planar-bottom surface 77 and an outer right full length foil planar-bottom surface 78 respectively, each ascending transversely up from a horizontal line at about 30° predetermined dihedral angle to the full hydroplaning hydrofoil/airfoil wingspan with longitudinal cut off ends. The dihedral angle broadest and preferred range is about 2° to 50° as shown in FIG. 13A and is the broad and preferred range for all hydroplaning hydrofoil/airfoil planar-bottom surfaces shown in this invention. The most preferred range is described in FIGS. 27–29. This structure of FIG. 13 has four fore foil planar-bottom sections 79, 80, 87 and 88 with four swept-back leading edges of about 60°. Fore foil planar-bottom sections 79 and 80 are formed by outer left and right planar-bottom surfaces 77 and 78 and fore foil planar-bottom sections 87 and 88 are formed by left and right foil planar-bottom surfaces 83 and 84. Planar-bottom surfaces 83 and 84 intersect outer left and right planar-bottom surfaces 77 and 78 at lower left and right longitudinal bottom line intersections 85 and 86 respectively, and with each other at elevated longitudinal bottom centerline 76. Outer left and right planar-bottom surfaces 77 and 78 have about 30° forward swept leading edges 81 and about 45° forward swept trailing edges 82 converging on elevated longitudinal bottom centerline 76 aft, forming four aft foil planar-bottom sections 68, 68, 69 and 69. The compass degree references of the leading and trailing edges in FIG. 13 may vary within the preferred range described in FIGS. 4–9 and 24–26.

The optional holes 89 along the elevated longitudinal bottom centerline 76 and lower left and lower right longitudinal bottom line intersections 85 and 86 provide the same amphibious and reverse direction performances as described in FIG. 10.

FIGS. 14 and 14A show a see through top view of the bottom plane or planar-bottom surfaces and a front view of a hydroplaning hydrofoil/airfoil structure for planing on a fluid surface of water having longitudinal bottom centerline 76 formed by two converging full length left side and right side foil planar-bottom surfaces 90 and 91 ascending transversely up from a horizontal line at about 15° (shown in FIG. 14A) predetermined dihedral angle to the left and right sides of the longitudinal bottom centerline 76, foil planar-bottom surfaces 90 and 91 having fore foil planar-bottom sections 92 and 93 respectively, swept-back with about 45° leading edges 98 that extend to the full width foil left and right planar-bottom surfaces 90 and 91, concluding at outer ends 99 from which about 45° forward swept trailing edges 94 converge on the longitudinal bottom centerline 76 aft, forming aft foil planar-bottom sections 102 and 103. The compass degree references of the leading and trailing edges in FIG. 14 may vary with up to about 25° more or less sweep within the scope of this configuration. Leading edges 98 and trailing edges 94 may be optionally curved or angled inward or outward as shown in FIG. 14 and FIGS. 18 and 12. The dihedral angle range for foil planar-bottom surfaces 90 and 91 is described in FIG. 13A. The structure in this FIG. 14 and all other hydroplaning hydrofoil/airfoil structure figures may be constructed and operated in two halves separated along section line 6—6 vertical to longitudinal bottom line 76 forming two structures.

A 25° dihedral angle hydroplaning step 95 is attached with bolt or screw 96 through hole 89 under fore foil planar-bottom sections 92 and 93. A fin or rudder 97 is attached with bolts or screws 96 on the underside of the hydroplaning hydrofoil/airfoil structure along longitudinal bottom centerline 76 or parallel to longitudinal bottom centerline 76. Step 95 and fin or rudder 97 may be attached as a step and fin combination, a step and rudder combination, fin only, or rudder only; and be permanently or reversibly attached to the hydroplaning hydrofoil/airfoil structure having the same amphibious and reverse direction performances as described in FIG. 10. Step 95 shown in FIG. 14A has a dihedral angle in the range of about 4° to 52° up from a horizontal transverse line and is the range for all steps attached to any of the hydroplaning hydrofoil/airfoil structures in this invention. Step 95 also has a wedge angle of attack of about 2° to 45° down from longitudinal bottom centerline 76 and is shown in more detail in FIGS. 15, 16B, and 17.

FIG. 15 is a cross section view of FIGS. 14 and 16 along line 6—6 and longitudinal bottom centerline 76 showing a hydroplaning hydrofoil/airfoil cross section from FIG. 17 with step 95 and fin or rudder 97 removably attached with bolts 96 (or screws or any other means) to provide the same amphibious and reverse direction performances as described in FIGS. 10, 14, and 14A. The step 95 wedge angle of attack is in the range of about 2° to 45° down from the longitudinal bottom centerline 76 as shown in FIG. 15 or any other figure where attached.

FIGS. 16 and 16A show a see through top view of the bottom plane or planar-bottom surfaces and a front view of a hydroplaning hydrofoil/airfoil structure for planing on a fluid surface of water having longitudinal bottom centerline 76 formed by two converging full length left side and right side foil planar-bottom surfaces 90 and 91 ascending transversely up from a horizontal line at about 15° (shown in FIG. 16A) predetermined dihedral angle to the left and right sides of the longitudinal bottom centerline 76, foil planar-bottom surfaces 90 and 91, having fore foil planar-bottom sections 92 and 93 respectively, swept-back with about 60° leading edges 98 that extend to the full width foil left and right planar-bottom surfaces 90 and 91, concluding at longitudinal outer ends 99 from which about 0° transverse trailing edges 100 converge on the longitudinal bottom centerline 76 aft, forming aft foil planar-bottom sections 102 and 103. The dihedral angle range for foil planar-bottom surfaces 90 and 91 is described in FIG. 13A. The compass degree references of the leading and trailing edges in FIG. 16 may vary with up to about 25° more or less sweep within the scope of this configuration. Leading edges 98 and trailing edges 100 may be optionally curved or angled inward or outward as shown in FIG. 16 and FIGS. 18 and 12.

A 30° dihedral angle hydroplaning step 95 is attached with bolt or screw 96 through hole 89 under fore foil planar-bottom sections 92 and 93. A fin or rudder 97 is attached with bolts or screws 96 on the underside of the hydroplaning hydrofoil/airfoil structure along longitudinal bottom centerline 76 or parallel to longitudinal bottom centerline 76. Step 95 and fin or rudder 97 may be attached in combinations as described for FIGS. 14 and 14A; and may be reversibly attached to the hydroplaning hydrofoil/airfoil structure having the same amphibious and reverse direction performances as described in FIG. 10.

FIG. 16B shows an isometric view of step 95 having a hole 101 which is in alignment with hole 89 under bolt or screw 96 in fore foil planar-bottom sections 79 and 80 or fore foil planar-bottom sections 92 and 93 through which bolt or screw 96 is used to secure step 95 to the underside of the planar-bottom fore sections. When used in the present invention, step 95 has an angle of attack in the range of about 2° to 45° down from longitudinal bottom centerline 76 shown in FIG. 15 and a dihedral angle in the range of about 4° to 52° up from a horizontal transverse line shown in FIG. 14A. The step shown may be made permanent or detachable and cut or shaped to fit along the underside of any of the hydroplaning hydrofoil/airfoil structures of this invention.

FIG. 17 shows a longitudinal top foil centerline 75 and bottom centerline 76 cross section view of an optionally reversible hydroplaning hydrofoil/airfoil cross section that has identical foil shape from the leading and trailing edges (81 and 82) to the center of the hydroplaning hydrofoil/airfoil chord length. This figure shows a six percent center chord maximum foil thickness between curved top foil centerline 75 and straight bottom centerline 76 as a percentage of its chord length; however, the percent of foil thickness is optional but usually around six percent of the chord length or in a broad range of less than one percent as in a sheet or plate to about twenty percent of the chord length for extra buoyancy in water and lift in water and air.

The cross sections in FIGS. 17–17F offer a substantial buoyancy range in water or fluid at static or slow speeds to partially or totally support a light weight watercraft, aquatic structure or a hydroplaning hydrofoil/airfoil structure itself above or in water or fluid.

FIG. 17 also shows a reversible rough water or snow hydroplaning step 95 and a fin or rudder 97 attached with removable bolts 96 or screws through holes 89 to provide the same amphibious and reverse direction performances as described in FIG. 10. If only one direction of motion is desired, the step 95 and fin or rudder 97 may be made as permanent fixtures, by any means, to the hydroplaning hydrofoil/airfoil structure of this invention. It should be added that the step 95 and fin or rudder 97 may be removed in some water or fluid conditions, but fin or rudder control would be required on snow and as a runner on ice. The fin or rudder 97 may also provide directional control through air similar to fin 62 shown in FIG. 41, and is an option with all cross sections shown in FIGS. 17–17F.

FIG. 17A shows a longitudinal centerline cross section view of a hydroplaning hydrofoil/airfoil shape designed to move primarily in one direction of motion showing a step 95 and a fin or rudder 97 bolted or screw attached 96 to the hydroplaning hydrofoil/airfoil structure of this invention. The step, fin or rudder may be made as permanent fixtures or completely removed in some water or fluid conditions as stated in FIG. 17. The step, fin or rudder may be attached by any means.

The ten percent, forward of center chord, maximum foil thickness in this Figure between the curved top foil centerline 75 and the nearly straight bottom centerline 76 is optional; but a broad range of less than one percent as in a sheet or plate to twenty percent of the chord length offers substantial buoyancy in water or fluid at static or slow speeds to partially or totally support a light weight watercraft, aquatic structure or a hydroplaning hydrofoil/airfoil structure above or in water or fluid.

FIG. 17B shows a longitudinal centerline cross section view of a hydroplaning hydrofoil/airfoil shape designed to move primarily in one direction of motion showing an elongated teardrop cross section having ten percent, forward of center chord, maximum foil thickness between the curved top foil centerline 75 and curved bottom centerline 76. The optional holes 89 provide a means to bolt or screw a detachable step, fin or rudder.

The foil thickness has a broad range of less than one percent as in a sheet or plate to twenty percent of the chord length in this figure, offering substantial buoyancy in water or fluid at static or slow speeds to partially or totally support a light weight watercraft, aquatic structure or a hydroplaning hydrofoil/airfoil structure above or in water or fluid.

FIG. 17C shows a longitudinal centerline cross section view of an optionally reversible hydroplaning hydrofoil/airfoil shape showing thin, spaced, substantially parallel top foil and bottom centerlines 75 and 76 that form a flat plate, planar, or sheet shaped hydroplaning hydrofoil/airfoil structure. The small leading and trailing edges 81 and 82 offer less resistance through water or a fluid including air and over snow, and optional holes 89 are for a detachable step 95 or fin or rudder 97. The foil thickness between the top foil centerline 75 and bottom centerline 76 may be very thin or increased and curvature added to offer substantial buoyancy in water or fluid at static or slow speeds to partially or totally support a light weight watercraft, aquatic structure or a hydroplaning hydrofoil/airfoil structure above or in water or fluid.

FIG. 17D shows a longitudinal centerline cross section view of a hydroplaning hydrofoil/airfoil shape designed to move primarily in one direction of motion. The leading edge in this figure is curved up several degrees ranging from about one degree to thirty-five degrees to hydroplane over rough water or fluid or run over snow. The optional holes 89 are for a detachable step 95 or fin, or rudder 97. The foil thickness between the top foil centerline 75 and bottom centerline 76 may be very thin as in a sheet or plate or increased and curvature added to offer substantial buoyancy in water or fluid at static or slow speeds to partially or totally support a light weight watercraft, aquatic structure or a hydroplaning hydrofoil/airfoil structure above or in water or fluid.

FIG. 17E shows a longitudinal centerline cross section view of an optionally reversible hydroplaning hydrofoil/airfoil forming an elongated oval shape having an airfoil cross section identical at the leading and trailing edges 81 and 82 to the center of the airfoil chord length. As with the cross section shown in FIG. 17, the percent of foil thickness between the curved top foil centerline 75 and curved bottom centerline 76 ranges from less than one percent as in a sheet or plate to twenty percent of the chord length. The foil thickness may be increased and curvature added to offer substantial buoyancy in water or fluid at static or slow speeds to partially or totally support a light weight watercraft, aquatic structure, or a hydroplaning hydrofoil/airfoil structure above or in water or fluid.

FIG. 17F shows a longitudinal centerline cross section view of a hydroplaning hydrofoil/airfoil having a substantially elongated wedge shape designed to move primarily in one direction of motion. The foil thickness or elongated wedge angle between the top centerline 75 and bottom centerline 76 may be very thin or increased and curvature added to offer substantial buoyancy in water or fluid at static or slow speeds to partially or totally support a light weight watercraft, aquatic structure, or a hydroplaning hydrofoil/airfoil structure above or in water or fluid.

Any of the hydroplaning hydrofoil/airfoil structures of this invention can be made from metal; composites, canvas sheets, paper sheets, plastic sheets, fiberglass, carbon graphite fiber, Kevlar® (aramid fibers), film sheets, fabric sheets, plastic or wood struts, foam or balsa core materials, molded plastic, laminated wood or plywood. Other wing covering materials and structural materials may be used to fabricate or mold the hydroplaning hydrofoil/airfoil structures of this invention.

FIG. 18 provides a general descriptive reference to all top views and see through foil top views of the bottom plane or planar-bottom surfaces of the hydroplaning hydrofoil/airfoil structure in this invention showing the shape or dotted line edge curvature options of all foil planar-bottom sections including leading edges 81 and 98 in FIGS. 12, 14, 16, 18, 19 and trailing edges 82, 94, and 100 in FIGS. 12, 14, 16, 18 and 19, and the detachable hydroplaning step 95 in forward and reverse positions with holes 89 along the longitudinal bottom centerline 76 for attaching an optionally reversible fin or rudder 97.

First, all forward swept and swept-back leading and trailing edges, in all figures, are measured in compass degrees transversely to the longitudinal bottom centerline 76 as shown for clarity with arrows and compass degrees in FIGS. 14, 16, 18, 19, and 21 through 29.

Second, all leading edges and trailing edges may be straight line edges or optionally curved or angled inward or outward to various curvatures, compound curves, angles or degrees as shown in FIG. 18 and FIGS. 12, 14, 16, and 19 within performances and the scope of this invention. All edge intersections may be curved, rounded or angled inwardly or outwardly, as also shown in FIGS. 18 and 13, and are within the scope of this invention.

Third, the detachable hydroplaning step 95 shown with dotted lines attached under the fore foil planar-bottom sections 79 and 80 may be turned around 180°, and reattached in a reverse position under the aft foil planar-bottom sections 68 and 69 for reverse direction of motion as described in FIG. 10. The optional holes 89 along longitudinal bottom centerline 76 provide a means to attach the step 95 or fin or rudder 97 also as described in FIG. 10.

FIG. 19 shows a see through top view of the bottom plane or planar-bottom surfaces of a hydroplaning hydrofoil/airfoil structure for planing on a fluid surface of water and is the same as the one shown in FIG. 16 except that it has about 30° inverted swept-back trailing edges 100 converging on the longitudinal bottom centerline 76 aft forming two aft foil planar-bottom sections 102 and 103. The compass degree references of the leading and trailing edges in FIG. 19 may vary with up to about 25° more or less sweep and are within the scope of this configuration. Leading edges 98 and trailing edges 100 may be optionally curved or angled inward or outward as shown in FIGS. 19, 18, and 12.

FIG. 20 is a front view of a hydroplaning hydrofoil/airfoil structure having a fore and aft longitudinal curved top foil centerline 75 and a bottom centerline 76 formed by two converging full length foil planar-bottom surfaces 77 and 78, and leading edges 81 ascending transversely at about 30° predetermined dihedral angle to the left and right sides of longitudinal bottom centerline 76; however, the dihedral angle can range from about 2° to 50° up in its broadest aspects from a horizontal line as shown in FIG. 13A. Attached to the structure along the underside of bottom centerline 76 is a transverse 40° dihedral angle step 95 and a vertical fin or rudder 97 attached with bolts or screws 96. The dihedral angle of the step can range from about 4° to 52° up from a horizontal line as shown in FIG. 14A.

Amphibious and reverse direction performances are as described in FIG. 10.

FIG. 20A is a front view of a hydroplaning hydrofoil-/airfoil structure having a fore and aft longitudinal curved top foil centerline 75 and a bottom centerline 76 formed by two converging full length foil planar-bottom surfaces 77 and 78 and leading edges 81 ascending transversely up through a gradual downward curve or arch between the longitudinal bottom centerline 76 and two foil tips or wing tips as shown. A straight line or chord drawn between the longitudinal bottom centerline 76 and either wing tip gives a dihedral angle in a range of about 2° to 50°.

As in other Figures, a vertical fin or rudder 97 is attached with bolts or screws 96. Amphibious and reverse direction performances are as described in FIG. 10.

FIG. 20B is a front view of a hydroplaning hydrofoil-/airfoil structure having a fore and aft longitudinal curved top foil centerline 75 and a bottom centerline 76 formed by two converging full length foil planar-bottom surfaces 77 and 78 and leading edges 81 ascending transversely in a gradual upward curve between the longitudinal bottom centerline 76 and two foil tips or wing tips as shown. A straight line or chord drawn between the longitudinal bottom centerline 76 and either wing tip gives a dihedral angle in a range of about 2° to 50°. As in other Figures, a step, vertical fin or rudder may be attached with bolts or screws through the dotted longitudinal centerline hole 89 (or holes) shown in this figure. Amphibious and reverse direction performances are as described in FIG. 10.

FIG. 20C is a front view of a hydroplaning hydrofoil-/airfoil structure having a fore and aft longitudinal curved top foil centerline 75 and a bottom centerline 76 formed by two converging full length foil planar-bottom surfaces 77 and 78 and leading edges 81 ascending transversely at high and low dihedral angles between the longitudinal bottom centerline 76 and two foil tips or wing tips as shown. A straight line or chord drawn between the longitudinal bottom centerline 76 and either wing tip gives a dihedral angle in a range of about 2° to 50°. As in other Figures, a step, fin or rudder may be attached with bolts or screws through the dotted longitudinal centerline hole 89 (or holes) shown in this figure. Amphibious and reverse direction performances are as described in FIG. 10.

FIG. 20D is a front view of a hydroplaning hydrofoil-/airfoil structure having a fore and aft longitudinal curved top foil centerline 75 and a bottom centerline 76 formed by two converging full length foil planar-bottom surfaces 77 and 78 and leading edges 81 ascending transversely at low and high dihedral angles between the longitudinal bottom centerline 76 and the two foil tips or wing tips as shown. A straight line or chord drawn between the longitudinal bottom centerline 76 and either wing tip gives a dihedral angle in a range of about 2° to 50°. As in the other Figures, a step, fin or rudder may be attached with bolts or screws through the dotted longitudinal centerline hole 89 (or holes) shown in this figure. Amphibious and reverse direction performances are as described in FIG. 10.

FIG. 20E is a front view of a hydroplaning hydrofoil-/airfoil structure having full length left side and right side foil planar-bottom surfaces 77 and 78 and leading edge 81 ascending transversely as shown from a center wing continuous curve to upward curved wing tips. A straight line or chord drawn from center wing leading edge 81 to either wing tip gives a dihedral angle in the range of about 2° to 50° up from a horizontal line. A step, fin or rudder described in FIG. 20D is optional. Amphibious and reverse direction performances are as described in FIG. 10.

Figure 21:
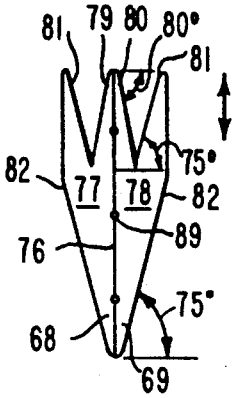
FIGS. 21 through 29 are see through top views of the bottom plane or planar-bottom surfaces of the hydroplaning hydrofoil/airfoil structures within the scope of the present invention showing the broadest, preferred, and most preferred compass degree angle ranges of various leading and trailing edges.

FIGS. 21, 22 and 23 are see through foil top views of the bottom plane or planar-bottom surfaces of hydroplaning hydrofoil/airfoil structures for planing on a fluid surface of water showing leading and trailing edges in their broadest aspects within the approximate compass degree range and scope of this invention. FIG. 22 structure will also plane through a fluid preferably air as described hereinafter for FIG. 22. All forward swept and swept-back leading and trailing edges in all Figures are measured in approximate compass degrees transversely to the longitudinal bottom centerline 76 as shown with arrows in FIGS. 14, 16, 18, 19 and 21-29. As with earlier drawings, the reference numerals are the same for clarity and simplification.

FIG. 21 is a see through top view of the bottom plane or planar-bottom surfaces which shows the leading edges of the fore foil left and right planar-bottom sections 79 and 80 swept-back at about 80°. The leading edges 81 of the left and right side foil planar-bottom surfaces 77 and 78 have a forward sweep of about 75°. Trailing edges 82 of the left and right aft foil planar-bottom sections 68 and 69 are forward swept at about 75°. An optional step and fin or rudder can be attached to the underside of the structure along bottom centerline 76 with bolts or screws through holes 89 as described in FIGS. 10 and 17, and in other figures.

FIG. 22, as with FIG. 21, is a see through top view of the bottom plane or planar-bottom surfaces which shows the leading edges of the fore foil left and right planar-bottom sections 79 and 80 swept-back at about 80°; however, as shown in this figure, leading edges 81 of the left and right side foil planar-bottom surfaces 77 and 78 are perpendicular to longitudinal bottom centerline 76 (i.e., about 0° transverse sweep). Trailing edges 82 of the left and right aft foil planar-bottom sections 68 and 69 are also perpendicular to longitudinal bottom centerline 76 (i.e., about 0° transverse sweep). This structure planes on a fluid surface of water and also planes through a fluid preferably air as claimed. Again, an optional step and fin or rudder can be attached to the underside of the structure along bottom centerline 76 with bolts or screws through holes 89 as described earlier in FIGS. 10, 17 and other figures.

FIG. 23 is a see through top view of the bottom plane or planar-bottom surfaces which shows the leading edges of the fore foil left and right planar-bottom sections 79 and 80 and the left and right side foil planar-bottom surfaces 77 and 78 both at about 0° transverse sweep (i.e., perpendicular to bottom centerline 76). As in FIG. 22, trailing edges 82 of the left and right aft foil planar-bottom sections 68 and 69 are also at about 0° transverse sweep (i.e., perpendicular to bottom centerline 76). With this configuration, an optional step 95 is attached to the underside of left and right fore foil planar-bottom sections 79 and 80 with bolt or screw 96 to the underside of the structure along longitudinal bottom centerline 76. Step 95 has ascending left side and right side dihedral angles in the range of about 4° to 52° as shown in FIG. 14A and left and right side foil planar-bottom surfaces 77 and 78 each have an ascending transverse dihedral angle from the bottom centerline 76 in the range of about 2° to 50° as shown in FIG. 13A. A fin or rudder 97 is attached by bolts or screws 96 to the underside of the hydroplaning hydrofoil/airfoil structure along longitudinal bottom centerline 76 to provide directional control at hydroplaning speeds described in FIGS. 4, 5, 6, 7 and 8. The step, fin or rudder can be made as permanent fixtures by any means. The angle of attack for the broadest aspects of the structure is about 1° to 16° up from a horizontal longitudinal line to the longitudinal bottom centerline 76 as shown in FIG. 5.

Figure 24:
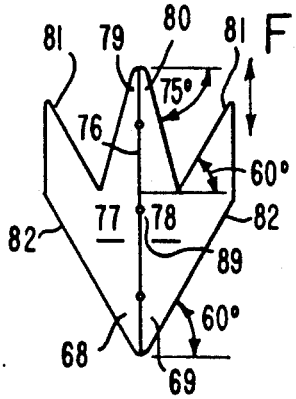

FIGS. 24, 25 and 26 are see through foil top views of the bottom plane or planar-bottom surfaces of hydroplaning hydrofoil/airfoil structures for planing on a fluid surface of water or through a fluid preferably air showing leading and trailing edges in their preferred aspects within the approximate compass degree range and scope of this invention. Again, the reference numerals are the same for clarity and simplification.

FIG. 24 is a see through top view of the bottom plane or planar-bottom surfaces which shows the leading edges of the fore foil left and right planar-bottom sections 79 and 80 swept-back at about 75°. Leading edges 81 of the left and right side foil planar-bottom surfaces 77 and 78 have a forward sweep of about 60°; and trailing edges 82 of the left and right aft foil planar-bottom sections 68 and 69 are forward swept at about 60°. An optional step and fin or rudder can be attached to the underside of the structure along bottom centerline 76 with bolts or screws through holes 89 as described in FIGS. 10, 17 and other figures.

FIG. 25, as with FIG. 24, is a see through top view of the bottom plane or planar-bottom surfaces which shows the leading edges of the fore foil left and right planar-bottom sections 79 and 80 swept-back at about 75°; however, as shown in this figure, leading edges 81 of left and right side foil planar-bottom surfaces 77 and 78 are forward swept at about 2°. Trailing edges 82 of the left and right aft foil planar-bottom sections 68 and 69 are forward swept at about 5°. Again, an optional step and fin or rudder can be attached by bolts or screws through holes 89 to the underside of the structure along bottom centerline 76.

FIG. 26 is a see through top view of the bottom plane or planar-bottom surfaces which shows the leading edges of the fore foil left and right planar-bottom sections 79 and 80 swept-back at about 30°; and the leading edges 81 of the left and right side foil planar-bottom surfaces 77 and 78 are forward swept at about 2°. Trailing edges 82 of the left and right aft foil planar-bottom sections 68 and 69 are forward swept at about 5°.

An optional step can be attached to the underside of left and right fore foil planar-bottom sections 79 and 80 by bolt or screw 96 as shown in FIG. 23 and is made to conform to an ascending preferred transverse dihedral angle of about 2° to 50° formed by the left and right side foil planar-bottom surfaces 77 and 78. Again, an optional fin or rudder can be attached by bolts or screws through holes 89. The preferred angle of attack for these preferred structures is about 2° to 15° up from a horizontal longitudinal line to the longitudinal bottom centerline 76.

Figure 27:
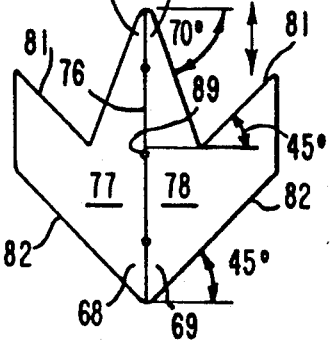
Figure 28:
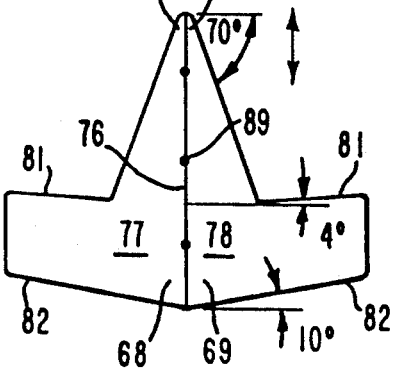
Figure 29:
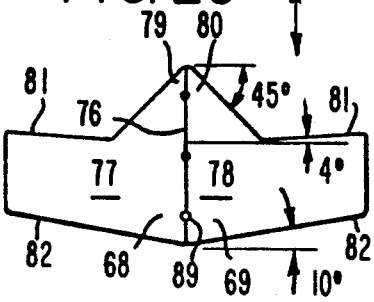

FIGS. 27, 28 and 29 are see through foil top views of the bottom plane or planar-bottom surfaces of hydroplaning hydrofoil/airfoil structures for planing on a fluid surface of water or through a fluid preferably air showing leading and trailing edges in their most preferred aspects within the approximate compass degree range and scope of this invention. Reference numerals are again the same for clarity and simplification.

FIG. 27 is a see through top view of the bottom plane or planar-bottom surfaces which shows the leading edges of the fore foil left and right planar-bottom sections 79 and 80 swept-back at about 70°. Leading edges 81 of the left and right side foil planar-bottom surfaces 77 and 78 have a forward sweep of about 45°; and trailing edges 82 of the left and right aft foil planar-bottom sections 68 and 69 are forward swept at about 45°. An optional step and fin or rudder can be attached to the underside of the structure along bottom centerline 76 with bolts or screws through holes 89 as described in FIGS. 10, 17 and other figures.

FIG. 28, as with FIG. 27, is a see through top view of the bottom plane or planar-bottom surfaces which shows the leading edges of the fore foil left and right planar-bottom sections 79 and 80 swept-back at about 70°; however, as shown in this figure, leading edges 81 of the left and right side foil planar-bottom surfaces 77 and 78 are forward swept at about 4°. Trailing edges 82 of the left and right aft foil planar-bottom sections 68 and 69 are forward swept at about 10°. Again, an optional step and fin or rudder can be attached by bolts or screws through holes 89 to the underside of the structure along bottom centerline 76.

FIG. 29 is a see through top view of the bottom plane or planar-bottom surfaces which shows the leading edges of the fore foil left and right planar-bottom sections 79 and 80 swept-back at about 45°; and the leading edges 81 of the left and right side foil planar-bottom surfaces 77 and 78 are forward swept at about 4°. Trailing edges 82 of the left and right aft foil planar-bottom sections 68 and 69 are forward swept at about 10°.

In the most preferred embodiments shown in FIGS. 27, 28 and 29, the ascending transverse dihedral angle formed by the left and right side foil planar-bottom surfaces 77 and 78 is most preferably in the range of about 2° to 30°. The optional step when attached to the underside of left and right fore foil planar-bottom sections 79 and 80 of these structures will conform to a dihedral angle which is predetermined. The angle of attack for these most preferred structures is in the range of about 2° to 15° up from a horizontal longitudinal line to the longitudinal bottom centerline 76. An optional fin or rudder can be attached by bolts or screws through holes 89 to the underside of the structure along longitudinal bottom centerline 76.

FIG. 30 is an overall top view of a sail 32, engine or electric motor 36 and propeller 37 power option, removably attached to a three hull amphibious tube structure component. FIG. 30 has the same hydroplaning hydrofoil/airfoil structure components 39, 40 and 41 as shown in FIGS. 1-9 and 32; however, the three hull amphibious tube structure component shown in FIG. 30 is a modification of the one shown in FIG. 3. In describing FIG. 30, the same reference numerals will be used as in FIGS. 1-9 for clarity and simplification for the same parts. As shown, a three hull amphibious tube structure component consists of a triangular three point hull float structure interconnected with port and starboard pivotal wings 105 and 106 and crossbeam tube connector 13 attached with bolts or screws 17 to the decks of a port bow hull 10 and a starboard bow hull 11 having a removable mast 21 stepped or attached to the center of crossbeam tube connector 13 on the longitudinal fore and aft centerline of watercraft 9.

The stern hull 12 is positioned aft at a distance along a longitudinal centerline between the port bow hull 10 and starboard bow hull 11 so that the three hulls are about equidistant; however, the stern hull 12 may be extended further aft forming an isosceles triangle three point hull float structure or further forward still forming a triangular three point hull float structure. Attached to the stern hull deck with bolts or screws 18 is a fore and aft extending port tube connector 16, and a fore and aft extending starboard tube connector 15, each angled out from the longitudinal centerline of stern hull 12 at about 33°, but may range from straight forward at 0° to an angle out of about 45° measured out from the longitudinal centerline of watercraft 9. Each fore and aft extending starboard and port tube connector 15 and 16 extends forward and out to the starboard and port hulls 11 and 10, and optionally bent, welded or braced forward to support each hull at or near the longitudinal centerline 61 of each hull for a short distance along or near the centerline on the two decks for screw or bolt attachments 104. The two fore and aft extending tube connectors 15 and 16 may pass over or under the crossbeam tube connector 13, or even bonded, braced or welded to the crossbeam tube to form the same or similar structure as shown in this figure. An optional stern hull crossbeam tube or brace 28, and curved forward traveler connector tube or support 29, are positioned across the fore section of stern hull 12 and are attached to the deck and two fore and aft extending tube connectors 15 and 16 with bolts or screws 18 or any other means for extra support, and controlling the sail 32 and boom 31 with mainsheet 30 (not shown, see FIG. 1). The traveler connector tube or support 29 may also be angled forward as shown in FIG. 3 or straight as shown in FIG. 32. A cockpit 33 and steering tiller 34 (showing direction of motion) are also positioned on the stern hull 12. The rigging (forestays 19 and 20, backstay 27, and shrouds 22 and 23) to support the mast 21, sail 32 and boom 31, may be attached as shown or anywhere on the three hull amphibious tube structure component.

The port and starboard pivotal wings 105 and 106, also shown in cross section FIG. 31B along line 7—7 of FIG. 30, may slide over, or fasten to crossbeam tube connector 13 with attachment means 107 to connect control lines, rods, or cables 108 back to the stern hull 12 and cleated as shown. Pivotal wings 105 and 106 are used for creating a positive or negative air or fluid lift to the watercraft; however, any other means including winches, joy sticks, and radio control or computer controlled servos can be used which will perform the same pivotal control function.

Details of connector shapes, in cross section, are shown in FIGS. 31A, C and D. FIG. 31A shows a circular tube; FIG. 31C, an elliptical connector for reduced air drag; and FIG. 31D shows a streamlined airfoil or teardrop shaped connector. While the connector cross sections shown are optional additions or replacements to the crossbeam tube connector 13, the shapes shown may vary in cross section and apply equally to all tube connectors used, e.g., crossbeam tube connectors 13 and 14, fore and aft starboard and port tube connectors 15 and 16, stern hull crossbeam tube or brace 28 and traveler connector tube or support 29.

As indicated in FIG. 3, the idea of having three hulls spread far apart connected only with tubes or other streamlined connectors shown in FIG. 31, offers extremely light weight, and stability, ideally matched for sailing on hydroplaning hydrofoil/airfoil structures. Again, materials for construction may range from light weight metal to high-tech composites for all structures shown in this invention.

The tubes, or other streamlined connectors shown in FIGS. 31A, C and D, are not limited to straight tubes or connectors. For example, the crossbeam tube connector 13 and pivotal wings 105, 106 shown in FIG. 30 may be arched or angled up slightly to a high point at the watercraft longitudinal centerline as shown in FIG. 30A to give better wave clearance, and for optional cable, rope, or rod reinforcements. Secondary tubes, rods, braces, and other connectors can be added to the primary three hull amphibious tube structure component and hydroplaning hydrofoil/airfoil structure component within the design, function, and scope of this invention.

FIG. 32 is an overall top view of a sail 32, engine or electric motor 36 and propeller 37 power option, removably attached to a three hull amphibious tube structure component. FIG. 32 has the same hydroplaning hydrofoil/airfoil structure components 39, 40 and 41 as shown in FIGS. 1–9 and 30; however, the three hull amphibious tube structure shown in FIG. 32 is a modification of the ones shown in FIG. 3 and FIG. 30. In describing FIG. 32 (as in FIG. 30), the same reference numerals will be used as in FIGS. 1–9 for clarity and simplification for the same parts. As shown, a three hull amphibious tube structure component consists of a triangular three point hull float structure interconnected with two crossbeam tube connectors 13 and 14 attached with bolts or screws 17 to the decks of a port bow hull 10 and a starboard bow hull 11 having a removable mast step tube or brace 35, positioned along a longitudinal fore and aft centerline of watercraft 9, attached at each end to the two crossbeam tube connectors 13 and 14.

The stern hull 12 is positioned aft at a distance along a longitudinal centerline between the port bow hull 10 and starboard bow hull 11 so that the three hulls are about equidistant; however, the stern hull 12 may be extended further aft forming an isosceles triangle three point hull float structure or further forward still forming a triangular three point hull float structure. Attached to the stern hull deck with bolts or screws 18 is a fore and aft extending starboard tube connector 15, and a fore and aft extending port tube connector 16, each angled out from the longitudinal centerline of stern hull 12 at about 33°, but may range from straight forward at 0° to an angle out of about 45° measured out from the longitudinal centerline of watercraft 9. Each fore and aft extending starboard and port tube connector 15 and 16 extends forward and out to the starboard and port hulls 11 and 10, diagonally extending across the two decks or part way across for screw or bolt attachments 104. The two fore and aft extending tube connectors 15 and 16 may pass over, or under the two crossbeam tube connectors 13 and 14, or even welded or braced to them to form the same or a similar structure as shown in this figure. A stern hull traveler connector tube or support 29 is positioned in the fore section of the stern hull 12 and is attached to the deck and two fore and aft extending tube connectors 15 and 16 with bolts or screws 18 for both extra support and controlling the sail 32 and boom 31 with mainsheet 30 (not shown, see FIG. 1). The traveler connector tube or support 29 may be positioned straight across as shown or curved forward as shown in FIG. 30 or angled forward as shown in FIG. 3. A cockpit 33 and steering tiller 34 (showing direction of motion) are also positioned on the stern hull 12. The rigging (forestays 19 and 20, shrouds 22 and 23, and backstay 27) to support the mast 21, sail 32, and boom 31 may be attached as shown or anywhere on the three hull amphibious tube structure component.

As indicated in FIGS. 3 and 30, the three hulls shown spread far apart connected only with tubes, or other streamlined connectors shown in FIG. 31 offer extremely light weight and stability, ideally matched for sailing on hydroplaning hydrofoil/airfoil structures. Again, materials for construction may range from light weight metal to high-tech composites for all structures in this invention.

The tube connectors in FIG. 32 and other streamlined connectors shown in FIG. 31, are not limited to straight tubes or connectors. For example, the two crossbeam tube connectors 13 and 14 shown in FIG. 32 can be arched or angled up slightly to a high point at watercraft 9 longitudinal centerline as shown in FIG. 30A to give better wave clearance, and for optional cable, rope, or rod reinforcements. Secondary tubes, rods, braces, and other connectors can be added to the primary three hull amphibious tube structure component and hydroplaning hydrofoil/airfoil structure component within the design, function, and scope of this invention.

The bolts or screws used for connecting the three hulls and tube connectors together in any of the above described figures offer two of several fastening options which include fastpins, hose clamps, pipe clamps, cast or molded fittings, tube or pipe bonding, bracing or welding, and other fastening means within the design, function, and scope of this invention.

Figure 8:
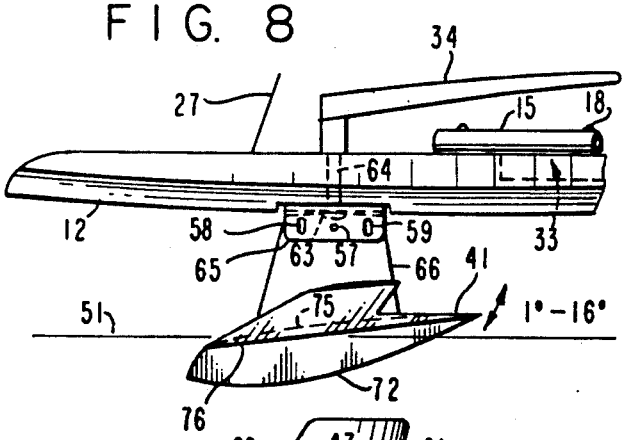
FIG. 8 is a side view of a hydroplaning hydrofoil/airfoil structure and a fragmentary side view of the stern hull of the structure shown in FIGS. 1–3 and 7.
Figure 34:
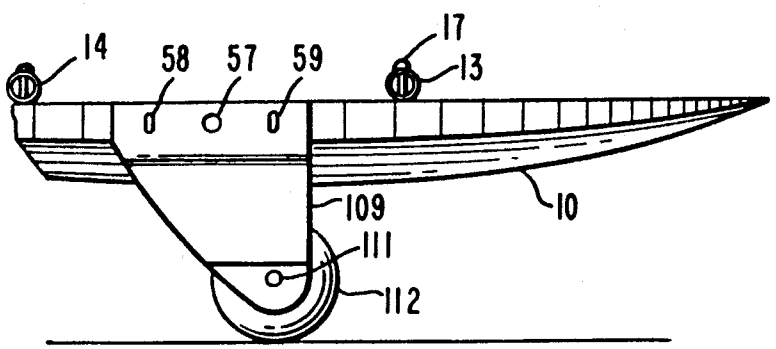
FIG. 34 is a fragmentary side view of the structure shown in FIG. 33.
Figure 36:
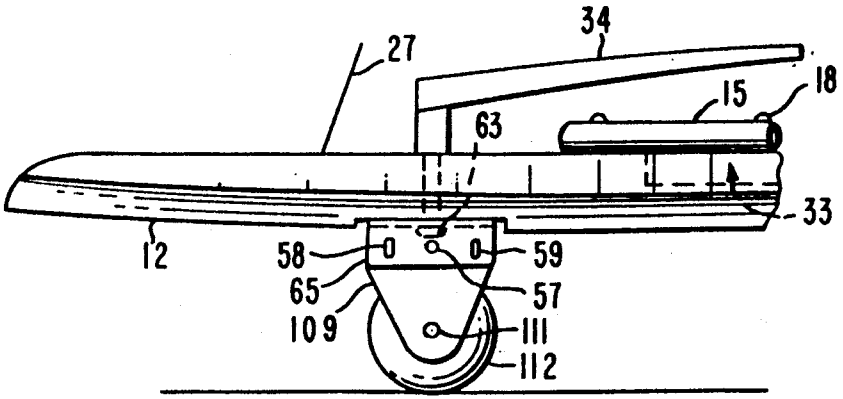
FIG. 36 is a fragmentary side view of the structure shown in FIG. 35.
Figure 33:
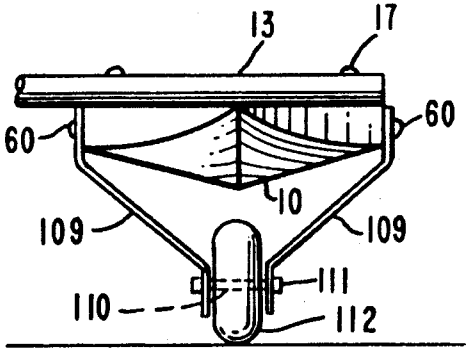
FIG. 33 is the same front view of the port bow hull shown in FIG. 4 with a removable strut mounted wheel.
Figure 35:
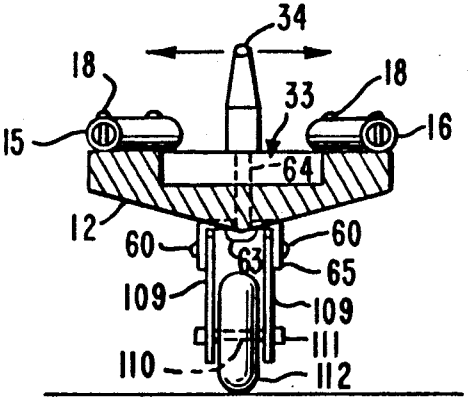
FIG. 35 is the same cross-sectional front view of the stern hull shown in FIG. 7 except having a removable strut mounted wheel.

FIGS. 33 and 34 are the same views as FIGS. 4 and 5; and FIGS. 35 and 36 are the same views as FIGS. 7 and 8 except the hulls shown have strut mounted wheels for operating the light weight three hull amphibious tube structure component over land.

FIG. 33 is a front view of the port bow hull 10: and FIG. 34 is a side view of the same structure shown in FIG. 33. The three hull amphibious tube structure component of this invention, by inherent design, will accommodate wheels 112 and struts 109 attachments. To convert from a watercraft to wheels on land, the three hydroplaning hydrofoil/airfoil structures 39, 40 and 41, and struts 53–56, 66 and 67 as shown in FIGS. 1–9 are removed from the port and starboard bow hulls 10 and 11, and stern hull 12 by removing bolts or screws 60. The three wheels 112 and struts 109 are then attached to the three hulls using the same adjusting bolts or screws 60 in pivot hole 57 and adjusting slots 58 and 59, ready to roll.

Shown in this view from top to bottom, is the forward most crossbeam tube connector 13, two bolts or screw attachments 17 through tube connector 13 into the port bow hull 10, two wheel struts 109 with bolt or screw attachments 60, a wheel 112, shaft 110, and lock nuts 111.

FIG. 34 is a side view of FIG. 33 with the same description, plus showing two crossbeam tube connectors 13 and 14, two vertical elongated adjusting slots 58 and 59, and a pivot hole 57, with bolts or screws 60 removed for clarity of view.

FIG. 35 is the same cross section front view of the stern hull 12 shown in FIG. 7, looking from the front showing the stern hull 12, cockpit 33, fore and aft starboard and port tube connectors 15 and 16, and from top to bottom, the steering tiller 34 with direction of motion arrows, the tiller shaft 63, shaft hole 64, strut bracket 65, two adjusting bolts or screws 60, four remaining bolts or screws (not shown), two wheel struts 109, a wheel 112, shaft 110, and lock nuts 111. The backstay 27, connected to the mast, is hidden from view in back of the steering tiller. The engine or electric motor 36, propeller 37, and stanchion support 38 shown in FIG. 1 are removed in FIG. 35 as a matter of power option between sail 32 or engine 36 and propeller 37.

FIG. 36 is a side view of FIG. 35 with the same description, plus showing two vertical elongated adjusting slots 58 and 59, and a pivot hole 57, with bolts or screws 60 removed for clarity of view. Bolts or screws 18 go through the fore and aft extending starboard and port tube connectors 15 and 16 for attachment to stern hull 12.

The struts 109 and wheels 112 are all removable as shown in FIGS. 33–36. With wheels, struts, and hydroplaning hydrofoil/airfoil structures removed, the light weight three hull amphibious tube structure can still be propelled on water, snow or ice with only a rudder and fins or runners added under the hulls. In addition, since the three hulls are not needed on land, the strut mounted wheels 112 and shafts 110 also may be attached directly to the triangular light weight tube structure in place of the three hulls.

As the hydroplaning hydrofoil/airfoil structure component is adaptable by inherent design to support a variety of light to medium displacement watercraft, aquatic structures, and airfoil structures, the three hull amphibious tube structure component, by inherent design, accommodates most any power means and will perform on water, snow, ice, and on land with wheel attachments.

Application of the three hull amphibious tube structure, as a matched component to the hydroplaning hydrofoil/airfoil structure, provides watercraft size options which range from toy size for kids, to model size for radio control, and full size as a passenger carrying aquatic structure or watercraft.

Figure 37:
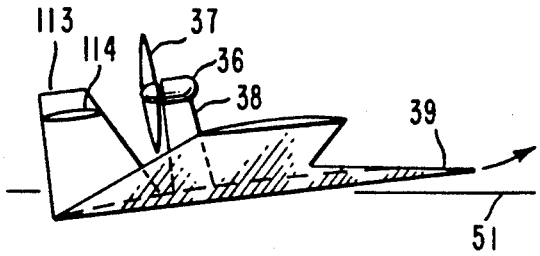
FIG. 37 is an enlarged side view identical in foil shape to the hydroplaning hydrofoil/airfoil structure shown in FIGS. 4-6, with fin and struts removed, showing a scaled down engine or electric motor air propeller drive from FIG. 1 plus a topside air rudder and elevator attachment.

Power means may be attached to the three hull amphibious tube structure as shown in FIG. 1 or directly to the hydroplaning hydrofoil/airfoil structure as shown in FIG. 37 and range from a tow string or line to toy size key wind up or rubber band power, to model engine or electric motor power, to human power rowing, human pedal-powered water or air propeller, to outboard engines, inboard or inboard-outboard engines, jet drives, airplane engine and propeller, wind powered wing sails, wing masts, and wind sail power from model size to passenger carrying and racing size.

Since the hydroplaning hydrofoil/airfoil structure is designed to lift or plane itself, a watercraft, aquatic structure or airfoil structure in or above water or fly through air with fluid supported planes or planar surfaces, said structure is adaptable by disclosed and inherent design to lift or plane at various speeds a variety of light to medium weight aquatic or airfoil structures, to include kneeboards, water skis, a person riding, standing or towed on said structure itself, skiboards, sailboards, surfboards, aquatic structures propelled by paddles or oars, aquatic structures propelled by pedal-driven propeller or paddle wheels, skiffs, canoes, shells, kayaks, dinghies, inflatable watercraft, rowboats, hydroplane hulls, water scooters, personal watercraft, pontoon or sponson float structures, single or multihull sailboats and motorboats, airboats, and ground-effect aircraft, seaplanes, ultralight tube or strut frame airfoil wing structures, airfoil wing watercraft, propelled airfoil or planar flying wing aircraft, airfoil or planar wing gliders, airfoil or planar wing kites, and other hydroplaning hydrofoil or airfoil fluid supported structures.

The descriptions for the figures in this invention provide details of design, construction, amphibious, and reverse direction versatility, power means, and aquatic or air supported structures, buoyancy and one or more fluid levels a hydroplaning hydrofoil/airfoil structure accelerates through to achieve either hydroplane or airfoil support. However, variations may be readily apparent to those skilled in the art without detracting from the realities of the structures and performances described in this invention. For example the hydroplaning hydrofoil/airfoil structure in its preferred and most preferred configurations offers additional performance options that include planing on or through a fluid such as water or air. Of course in an airfoil configuration such as an ultralight wing aircraft, glider wing or kite, the same shape hydroplaning hydrofoil/airfoil structure performs as an airfoil wing structure or planar wing structure planing or flying through air herein described.

As will be evidenced from the title of this invention, a hydroplaning hydrofoil/airfoil structure for planing on or flying through a fluid is shown supporting itself in FIGS. 37 to 41. In describing these Figures, the same reference numerals for the same parts will be used as in FIGS. 4–6 for clarity and simplification.

Figure 40:
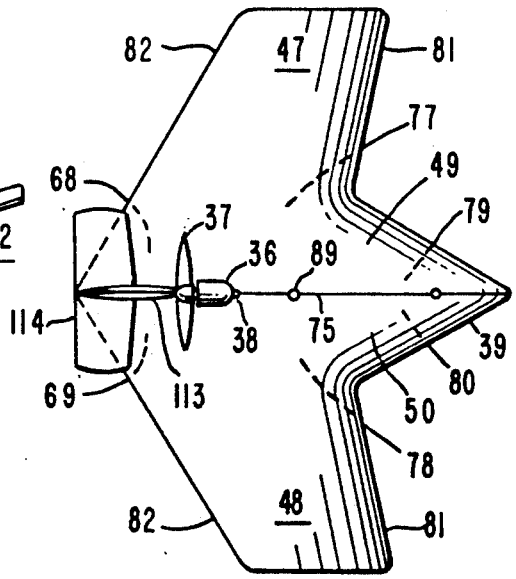
FIG. 40 is a top view of a hydroplaning hydrofoil-/airfoil structure shown in FIGS. 37, 38, and 39.

FIG. 37 is an enlarged side view, similar to the hydroplaning hydrofoil/airfoil structure 39 shown in FIGS. 4, 5, and 6 with fin 62 and struts 53–54 removed, showing an engine or electric motor 36 and air propeller 37 from FIG. 1 mounted on stanchion 38 plus a topside air rudder 113 mounted along longitudinal top foil centerline 75 as shown in FIG. 40 and elevator or aileron 114 attachment to air rudder 113. This buoyant hydroplaning hydrofoil/airfoil structure 39 is shown hydroplaning at water level 51 prior to flight and in FIG. 38 the hydroplaning hydrofoil/airfoil structure 39 or flying wing, planes or flies through air in sustained flight.

Figure 38:
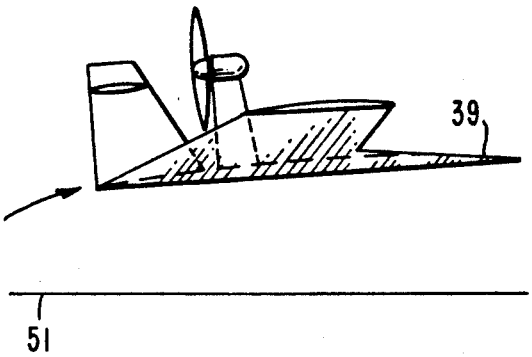
FIG. 38 is the same side view of a hydroplaning hydrofoil/airfoil structure shown in FIG. 37 ascending as an airfoil structure or flying wing planing or flying through air in sustained flight.
Figure 39:
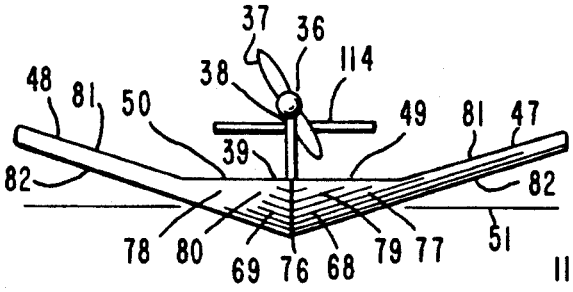
FIG. 39 is a front view of a hydroplaning hydrofoil-/airfoil structure shown in FIG. 37 hydroplaning on a fluid surface of water.

FIG. 39 is a front view and FIG. 40 is a top view of the hydroplaning hydrofoil/airfoil structure 39 shown in FIGS. 37 and 38 hydroplaning at water level 51 and is similar to the structure shown in FIGS. 4–6 having the same reference numerals as shown in FIG. 6 with fin 62 and struts 53–54 removed.

Figure 41:
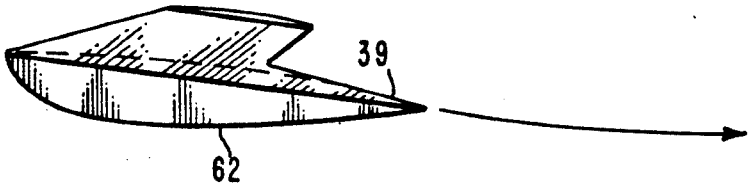
FIG. 41 is an enlarged side view of a hydroplaning hydrofoil/airfoil structure, identical in foil shape to said structures shown in FIGS. 4, 5, and 6, gliding or planing through air.

FIG. 41 is a side view of the identical hydroplaning hydrofoil/airfoil structure 39 shown in FIGS. 4–6 gliding or planing through air. In this Figure, fin 62 is retained.

As described for FIGS. 4–6, the hydroplaning hydrofoil/airfoil structure 39 in FIGS. 39 and 40 has a left side foil top surface 47 and a right side foil top surface 48 each having a fore foil top section (49 and 50 respectively) converging to form a full length fore and aft longitudinal top foil centerline 75, and a bottom centerline 76 formed by two converging full length foil planar-bottom surfaces, a left side foil planar-bottom surface 77 and a right side foil planar-bottom surface 78. Foil planar-bottom surfaces 77 and 78 ascend transversely from the longitudinal bottom centerline 76 to form a dihedral angle of about 18° as shown or in the range of about 2° to 50° broadly or preferably also in the range of about 2° to 50° or most preferably in the range of about 2° to 30°. Each left side foil planar-bottom surface 77 and right side foil planar-bottom surface 78 has a fore foil planar-bottom section (79 and 80 respectively) which is a forward extension along the longitudinal bottom centerline 76. Each fore foil planar-bottom section has a swept-back leading edge of 60° as shown or one preferably ranging from about 30° to about 80° swept-back as described for FIGS. 22 and 26 or most preferably ranging from about 45° to about 70° swept-back as described for FIGS. 27–29.

The length of each fore foil planar-bottom section 79 and 80, as shown in FIG. 40 is the same as described for FIGS. 5 and 6, and is about the first one-third of the entire length or chord of the hydroplaning hydrofoil/airfoil structure along longitudinal top foil and bottom centerlines 75 and 76: however, the length of the fore foil planar-bottom sections in their broadest aspects can range from 0° shown in FIG. 23 or in the preferred length of about one-fourth of the chord length shown in FIG. 26 to about the first two-thirds to three-fourths of the chord length along top foil and bottom centerlines 75 and 76 shown in FIGS. 22 and 25.

Each left side foil planar-bottom surface 77 and right side foil planar-bottom surface 78 has an aft foil planar-bottom section which is a backward or aft extension along the longitudinal bottom centerline 76. As shown in FIGS. 39 and 40, each aft foil planar-bottom section 68 and 69 at high speed water or fluid level 51 has a forward swept trailing edge 82 of 30° as shown or one preferably ranging from about 0° to about 60° forward swept as described for FIGS. 22 and 24–26 or most preferably from about 10° to about 45° forward swept as described for FIGS. 27–29.

The length of each aft foil planar-bottom section 68 and 69 is about the last one-fourth to about one-third of the entire chord length of the hydroplaning hydrofoil/airfoil structure along longitudinal bottom centerline 76 at high speed water or fluid level 51 as shown in FIG. 39. The aft foil planar-bottom sections 68 and 69 vary in wetted surface area and length with speed and load; however, it is the section of the hydroplaning hydrofoil/airfoil structure which provides for high speed hydroplaning prior to sustained flight.

The left side and right side foil planar-bottom surfaces 77 and 78 have left wing and right wing forward swept leading edges 81 of 12° as shown in FIG. 40; however, left and right leading edges 81 can be forward swept preferably in the range of about 0° to about 60° forward sweep as described for FIGS. 22 and 24–26, or most preferably in the range of about 4° to about 45° forward sweep as described for FIGS. 27–29. Foil planar-bottom surfaces 77 and 78 have forward swept trailing edges coextensive with aft foil planar-bottom section trailing edge 82, i.e., forward swept 30° as shown, but with forward swept ranges as described above.

The angle of attack may range from about 1° to 16° as described earlier for FIGS. 21–23 while accelerating through water level 51 before becoming airborne in sustained flight. Once airborne, the angle of attack varies greatly depending on speed, payload, and whether the airfoil structure 39 is ascending or descending. Motor 36, air propeller 37, stanchion 38, topside air rudder 113 and elevator 114 are as described in FIG. 37.

Optional holes 89 shown in FIG. 40 accommodate optional step 95 as described more fully for the description of FIG. 10 and as shown in FIGS. 14A, 15, 16B and 17. These optional holes will also accommodate removable or permanent fin 62 as shown in FIGS. 5 and 41 or a rudder 72 as shown in FIGS. 7 and 8.

Optional power, wing stabilizers including winglets and canards, landing wheels, and passenger or payload carrying enclosures may be built in or attached to various scale hydroplaning hydrofoil or airfoil structures for gliding or propelled flight. In concluding the description of this invention, a light weight hydroplaning hydrofoil/airfoil structure selected from FIGS. 4, 5, 6, and 17, enlarged but of identical foil shape, and merely having a weight added to the fore foil sections, performed repetitiously with a surprisingly long glide path, planing or gliding through air, supporting the inherent versatility of the disclosed structures of this invention to plane on or fly through a fluid preferably either water or air. This fore foil stabilized hydroplaning hydrofoil-/airfoil structure in the spirit of flight is shown gliding in FIG. 41.

Glossary Reference For Clarity
Hydroplaning Hydrofoil/Airfoil Structures
and Amphibious and Aquatic Craft

| Reference Numerals | Part | Figures |
|---|---|---|
| 1. | | |
| 2. | | |
| 3. | | |
| 4. | | |
| 5. | ← 5<br>\|<br>← 5 Cross section along line 5 | 3 |
| 6. | 6 → ← 6<br>\| \|<br>6 → ← 6 Cross section along line 6 | 14, 16 |
| 7. | ← 7<br>\|<br>← 7 Cross section along line 7 | 30 |
| 8. | ← 8<br>\|<br>← 8 Cross section along line 8 | 3 |
| 9. | watercraft | 1, 3, 30, 32 |
| 10. | port bow hull | 2–5, 30, 32, 33, 34 |
| 11. | starboard bow hull | 1–3, 30, 32 |
| 12. | stern hull | 1–3, 7, 8, 30, 32, 35, 36 |
| 13. | crossbeam tube connector | 1–5, 30–34 |
| 14. | crossbeam tube connector | 1, 3, 5, 32. 34 |
| 15. | fore and aft extending starboard tube connector | 1–3, 7, 8, 30, 32, 35, 36 |
| 16. | fore and aft extending port tube connector | 2, 3, 7, 30, 32, 35 |
| 17. | bolts or screws | 2–5, 30, 32, 33, 34 |
| 18. | bolts or screws | 1, 3, 7, 8, 30, 32, 35, 36 |
| 19. | forestay (starboard side) | 1, 3, 30, 32 |
| 20. | forestay (port side) | 3, 30, 32 |
| 21. | mast | 1, 3, 30, 32 |
| 22. | shroud (starboard side) | 1, 3, 30, 32 |
| 23. | shroud (port side) | 3, 30, 32 |
| 24. | shroud (starboard side) | 1, 3 |
| 25. | shroud (port side) | 3 |
| 26. | bolts or screws | 3 |
| 27. | backstay | 1, 3, 8, 30, 32, 36 |
| 28. | stern hull crossbeam tube or brace | 3, 30 |
| 29. | traveler connector tube or support | 1, 2, 3, 30, 32 |
| 30. | mainsheet | 1 |
| 31. | boom | 1, 3, 30, 32 |
| 32. | mainsail or sail | 1, 3, 30, 32 |
| 33. | cockpit | 1, 3, 7, 8, 30, 32, 35, 36 |
| 34. | steering tiller and directional arrows | 1, 2, 3, 7, 8, 30, 32, 35, 36 |
| 35. | mast step tube or brace | 3, 32 |
| 36. | engine or electric motor | 1, 2, 3, 30, 32, 37–40 |
| 37. | propeller | 1, 2, 3, 30, 32 37–40 |
| 38. | stanchion support | 1, 2, 37–40 |
| 39. | hydroplaning hydrofoil/airfoil structure | 2, 3–6, 30, 32, 37–41 |
| 40. | hydroplaning hydrofoil/airfoil structure | 1–3, 30, 32 |
| 41. | hydroplaning hydrofoil/airfoil structure | 1–3, 7–9, 30, 32 |

-continued

Glossary Reference For Clarity
Hydroplaning Hydrofoil/Airfoil Structures
and Amphibious and Aquatic Craft

| Reference Numerals | Part | Figures |
|---|---|---|
| 42. | ice level | 4, 5 |
| 43. | static water or fluid level | 4, 5 |
| 44. | initial water or fluid level at low speed | 4, 5 |
| 45. | hydrofoil and airfoil support range | 4 |
| 46. | water or fluid level at medium speed | 4, 5 |
| 47. | left side foil top surface | 6, 7, 9, 39, 40 |
| 48. | right side foil top surface | 6, 7, 9, 39, 40 |
| 49. | left fore foil top section | 6, 39, 40 |
| 50. | right fore foil top section | 6, 39, 40 |
| 51. | water or fluid level at high speed | 1, 2, 4–8, 37–39 |
| 52. | hydroplaning support range | 4 |
| 53. | pivotal strut (port outside) | 2, 3, 4, 6 |
| 54. | pivotal strut (port inside) | 2–6 |
| 55. | pivotal strut (starboard inside) | 2, 3 |
| 56. | pivotal strut (starboard outside) | 1, 2, 3 |
| 57. | pivot hole (to pivot struts) | 5, 8, 34, 36 |
| 58. | vertical elongated adjusting slot | 5, 8, 34, 36 |
| 59. | vertical elongated adjusting slot | 5, 8, 34, 36 |
| 60. | bolts or screws | 2–4, 6, 7, 33, 35 |
| 61. | longitudinal centerline (hulls) | 3, 30, 32 |
| 62. | fin | 1, 2, 4–6, 41 |
| 63. | tiller shaft | 7, 8, 35, 36 |
| 64. | shaft hole | 7, 8, 9 |
| 65. | strut bracket | 2, 7–9, 35, 36 |
| 66. | strut (starboard side) | 1, 7–9 |
| 67. | strut (port side) | 7, 9 |
| 68. | left aft foil planar-bottom section | 6, 10–13, 18, 21–29, 39, 40 |
| 69. | right aft foil planar-bottom section | 6, 10–13, 18, 21–29, 39, 40 |
| 70. | bolts, screws or rivets | 6, 9 |
| 71. | strut flange | 6, 9 |
| 72. | rudder | 1, 2, 7–9 |
| 73. | bolts or screws (to attach fins) | 6 |
| 74. | bolts or screws (to attach rudder) | 9 |
| 75. | longitudinal top foil centerline | 5, 6, 8, 9, 17, 20, 40 |
| 76. | longitudinal bottom centerline | 5, 8, 10–29, 39 |
| 77. | full length left side foil planar-bottom surface | 6, 7, 10–13, 18 20, 21–29, 39, 40 |
| 78. | full length right side foil planar-bottom surface | 6, 7, 10–13, 18, 20, 21–29, 39, 40 |
| 79. | left fore foil planar-bottom section | 6, 10–13, 18, 21–29, 39, 40 |
| 80. | right fore foil planar-bottom section | 6, 10–13, 18 21–29, 39, 40 |
| 81. | leading edge | 6, 7, 9, 10–13, 17, 18, 20–29, 39, 40 |
| 82. | trailing edge | 6, 9, 10–13, 17, 18, 21–29, 39, 40 |
| 83. | left side foil planar-bottom surface | 13 |
| 84. | right side foil planar-bottom surface | 13 |
| 85. | lower left longitudinal bottom line intersection | 13 |
| 86. | lower right longitudinal bottom line intersection | 13 |
| 87. | fore foil planar-bottom section | 13 |
| 88. | fore foil planar-bottom section | 13 |
| 89. | optional holes | 10–13, 17, 18, 20–22, 24–29, 40 |
| 90. | full length left side foil planar-bottom surface | 14, 16, 19 |
| 91. | full length right side foil planar-bottom surface | 14, 16, 19 |
| 92. | left fore foil planar-bottom section | 14, 16, 19 |
| 93. | right fore foil planar-bottom section | 14, 16, 19 |
| 94. | forward swept trailing edge | 14 |
| 95. | step | 14A, 15, 16A–B, |

-continued

Glossary Reference For Clarity
Hydroplaning Hydrofoil/Airfoil Structures
and Amphibious and Aquatic Craft

| Reference Numerals | Part | Figures |
|---|---|---|
| | | 17, 17A, 18, 20, 23 |
| 96. | bolts or screws (to attach step, fin or rudder) | 14, 14A, 15, 16, 16A, 17, 17A, 20, 20A, 23 |
| 97. | fin or rudder | 14, 14A, 15, 16, 16A, 17, 17A, 20, 20A, 23 |
| 98. | leading edge | 14, 16, 19 |
| 99. | outer ends | 14, 16, 19 |
| 100. | trailing edge | 16, 19 |
| 101. | hole (in step) | 16B |
| 102. | left aft foil planar-bottom section | 14, 16, 19 |
| 103. | right aft foil planar-bottom section | 14, 16, 19 |
| 104. | screw or bolt attachments | 30, 32 |
| 105. | port pivotal wing | 30 |
| 106. | starboard pivotal wing | 30, 31B |
| 107. | attachment means | 30, 31B |
| 108. | control lines, rods, or cables | 30, 31B |
| 109. | strut (for wheels) | 33-36 |
| 110. | shaft (for a wheel) | 33, 35 |
| 111. | lock nut | 33-36 |
| 112. | wheel | 33-36 |
| 113. | topside air rudder | 37, 38, 40 |
| 114. | elevator or aileron | 37-40 |

What is claimed is:

1. A hydroplaning hydrofoil/airfoil structure for planing on or through a fluid of water or air comprising: at least two foils each having a substantially planar-bottom surface, two of said surfaces intersecting along a fore and aft longitudinal bottom centerline forming a left side foil substantially planar-bottom surface and a right side foil substantially planar-bottom surface, each foil planar-bottom surface ascending transversely from said longitudinal bottom centerline to form a dihedral angle in the range of about 2° to 50° up from a transverse horizontal line and having a positive angle of attack of about 1° to 16° in the direction of motion from a horizontal longitudinal line up to said longitudinal bottom centerline, each said left and right foil substantially planar-bottom surface having a forward swept leading edge ranging from about 20° from a line perpendicular to said longitudinal bottom centerline to about 60° forward sweep, and each said left and right foil substantially planar-bottom surface having a fore foil planar-bottom section and an aft foil planar-bottom section intersecting along said fore and aft longitudinal bottom centerline, each fore foil planar-bottom section having a swept-back leading edge ranging from about 30° from a line perpendicular to said longitudinal bottom centerline to about 80° swept-back, and each aft foil planar-bottom section having a forward swept trailing edge ranging from about 50° from a line perpendicular to said longitudinal bottom centerline to about 60° forward swept.

2. The hydroplaning hydrofoil/airfoil structure of claim 1 wherein at least one substantially vertically extending fin or rudder is affixed to the underside of the structure.

3. The hydroplaning hydrofoil/airfoil structure of claim 1 wherein said structure has propulsion means affixed thereto.

4. The hydroplaning hydrofoil/airfoil structure of claim 1 wherein a hydroplaning step is affixed to the underside of the fore foil planar-bottom sections, relative to the direction of motion, along the longitudinal bottom centerline, said hydroplaning step having a wedge angle of attack in the range of about 2° to 45° down from the longitudinal bottom centerline and a dihedral angle in the range of about 4° to 52° up from a horizontal transverse line.

5. The hydroplaning hydrofoil/airfoil structure of claim 1 wherein at least one of the leading or trailing edges are curved and at least one of the edge intersections are rounded.

6. The hydroplaning hydrofoil/airfoil structure of claim 1 wherein said structure is divided vertically in half through the longitudinal centerline providing two separate structures.

7. The hydroplaning hydrofoil/airfoil structure of claim 1 wherein said structure is reversible in the longitudinal direction of motion.

8. The hydroplaning hydrofoil/airfoil structure of claim 1 wherein said structure includes means for attaching said structure to an aquatic structure or watercraft.

9. The hydroplaning hydrofoil/airfoil structure of claim 1 wherein said structure includes means for controlling the angle of attack.

10. The hydroplaning hydrofoil/airfoil structure of claim 1 wherein said structure includes means for rotating the structure for directional control.

11. The hydroplaning hydrofoil/airfoil structure of claim 1 wherein each said foil substantially planar-bottom surface forms with a foil top surface a cross section thickness whereby the foil or chord thickness between leading and trailing edge intersections creates lift planing through air or buoyancy to support said structure in water.

12. The hydroplaning hydrofoil/airfoil structure of claim 11 wherein at least one substantially vertically extending air rudder or fin is affixed to the topside of said structure.

13. The hydroplaning hydrofoil/airfoil structure of claim 11 wherein each foil top surface is covered and forms with each foil substantially planar-bottom surface a cross section thickness that is substantially identical at the leading and trailing edges to the center of the chord length whereby said structure is optionally reversible in the longitudinal direction of motion.

14. The hydroplaning hydrofoil/airfoil structure of claim 11 wherein each foil top surface is curved and forms with each foil substantially planar-bottom surface a cross section thickness whereby the maximum chord thickness is forward of the center of structure length to provide a structure which moves in one direction of motion.

15. The hydroplaning hydrofoil/airfoil structure of claim 11 wherein each foil top surface is curved and forms with each foil bottom surface an elongated teardrop cross section thickness to provide a structure which moves in one direction of motion.

16. The hydroplaning hydrofoil/airfoil structure of claim 11 wherein each foil top surface is substantially parallel to each foil planar-bottom surface and forms a substantially flat plate or sheet cross section thickness whereby said structure is optionally reversible in the longitudinal direction of motion.

17. The hydroplaning hydrofoil/airfoil structure of claim 16 wherein the substantially flat plate or sheet curves up in the range of about 1° to 35° in the fore section in the direction of motion.

18. The hydroplaning hydrofoil/airfoil structure of claim 11 wherein each foil top surface is curved and each foil bottom surface is curved and forms an elongated oval cross section thickness that is substantially identical at the leading and trailing edges to the center of the chord length whereby said structure is optionally reversible in the longitudinal direction of motion.

19. The hydroplaning hydrofoil/airfoil structure of claim 11 wherein each foil top surface forms with each foil bottom surface a substantially elongated wedge cross section thickness between the leading and trailing edges whereby said structure moves in one direction of motion.

20. A hydroplaning hydrofoil/airfoil structure for planing on or through a fluid of water or air comprising: at least two foils each having a substantially planar-bottom surface, two of said surfaces intersecting along a fore and aft longitudinal bottom centerline forming a left side foil substantially planar-bottom surface and a right side foil substantially planar-bottom surface, each foil planar-bottom surface ascending transversely from said longitudinal bottom centerline to form a dihedral angle in the range of about 2° to 50° up from a transverse horizontal line and having a positive angle of attack of about 2° to 15° in the direction of motion from a horizontal longitudinal line up to said longitudinal bottom centerline, each said left and right foil substantially planar-bottom surface having a forward swept leading edge ranging from about 2° from a line perpendicular to said longitudinal bottom centerline to about 60° forward sweep, and each said left and right foil substantially planar-bottom surface having a fore foil planar-bottom section and an aft foil planar-bottom section intersecting along said fore and aft longitudinal bottom centerline, each fore foil planar-bottom section having a swept-back leading edge ranging from about 30° from a line perpendicular to said longitudinal bottom centerline to about 75° swept-back, and each aft foil planar-bottom section having a forward swept trailing edge ranging from about 5° from a line perpendicular to said longitudinal bottom centerline to about 60° forward swept.

21. The hydroplaning hydrofoil/airfoil structure of claim 20 wherein at least one substantially vertically extending fin or rudder is affixed to the underside of the structure.

22. The hydroplaning hydrofoil/airfoil structure of claim 20 wherein said structure has propulsion means affixed thereto.

23. The hydroplaning hydrofoil/airfoil structure of claim 20 wherein a hydroplaning step is affixed to the underside of the fore foil planar-bottom sections, relative to the direction of motion, along the longitudinal bottom centerline, said hydroplaning step having a wedge angle of attack in the range of about 2° to 45° down from the longitudinal bottom centerline and a dihedral angle in the range of about 4° to 52° up from a horizontal transverse line.

24. The hydroplaning hydrofoil/airfoil structure of claim 20 wherein at least one of the leading or trailing edges are curved and at least one of the edge intersections are rounded.

25. The hydroplaning hydrofoil/airfoil structure of claim 20 wherein said structure is divided vertically in half through the longitudinal centerline providing two separate structures.

26. The hydroplaning hydrofoil/airfoil structure of claim 20 wherein said structure is reversible in the longitudinal direction of motion.

27. The hydroplaning hydrofoil/airfoil structure of claim 20 wherein said structure includes means for attaching said structure to an aquatic structure or watercraft.

28. The hydroplaning hydrofoil/airfoil structure of claim 20 wherein said structure includes means for controlling the angle of attack.

29. The hydroplaning hydrofoil/airfoil structure of claim 20 wherein said structure includes means for rotating, the structure for directional control.

30. The hydroplaning hydrofoil/airfoil structure of claim 20 wherein each said foil substantially planar-bottom surface forms with a foil top surface a cross section thickness whereby the foil or chord thickness between leading and trailing edge intersections creates lift planing through air or buoyancy to support said structure in water.

31. The hydroplaning hydrofoil/airfoil structure of claim 30 wherein at least one substantially vertically extending air rudder or fin is affixed to the top side of said structure.

32. The hydroplaning hydrofoil/airfoil structure of claim 30 wherein each foil top surface is curved and forms with each foil substantially planar-bottom surface a cross section thickness that is substantially identical at the leading and trailing edges to the center of the chord length whereby said structure is optionally reversible in the longitudinal direction of motion.

33. The hydroplaning hydrofoil/airfoil structure of claim 30 wherein each foil top surface is curved and forms with each foil substantially planar-bottom surface a cross section thickness whereby the maximum chord thickness is forward of the center of structure length to provide a structure which moves in one direction of motion.

34. The hydroplaning hydrofoil/airfoil structure of claim 30 wherein each foil top surface is curved and forms with each foil bottom surface an elongated teardrop cross section thickness to provide a structure which moves in one direction of motion.

35. The hydroplaning hydrofoil/airfoil structure of claim 30 wherein each foil top surface is substantially parallel to each foil planar-bottom surface and forms a substantially flat plate or sheet cross section thickness whereby said structure is optionally reversible in the longitudinal direction of motion.

36. The hydroplaning hydrofoil/airfoil structure of claim 35 wherein the substantially flat plate or sheet curves up in the range of about 1° to 35° in the fore section in the direction of motion.

37. The hydroplaning hydrofoil/airfoil structure of claim 30 wherein each foil top surface is curved and each foil bottom surface is curved and forms an elongated oval cross section thickness that is substantially identical at the leading and trailing edges to the center of the chord length whereby said structure is optionally reversible in the longitudinal direction of motion.

38. The hydroplaning hydrofoil/airfoil structure of claim 30 wherein each foil top surface forms with each foil bottom surface a substantially elongated wedge cross section thickness between the leading and trailing edges whereby said structure moves in one direction of motion.

39. An aquatic structure or watercraft comprising: at least one buoyant hull, a hydroplaning hydrofoil/airfoil structure of claim 20 mounted on the underside of each hull with the fore and aft longitudinal centerline of said hydroplaning hydrofoil/airfoil structure under the longitudinal axis of each hull, and propulsion means mounted on said watercraft for powering the watercraft.

40. The watercraft of claim 39 wherein the propulsion means is a sailing rig.

41. The watercraft of claim 39 wherein the hydroplaning hydrofoil/airfoil structure includes means for rotating the structure for directional control of the watercraft.

42. The watercraft of claim 41 wherein the hydroplaning hydrofoil/airfoil structure has at least one substantially vertically extending rudder affixed to the underside of the structure.

43. The watercraft of claim 39 wherein said watercraft includes means for controlling the angle of attack.

44. An aquatic structure or watercraft comprising: a port bow hull, a starboard bow hull, and a stern hull, said hulls forming a triangular configuration all rigidly connected; a hydroplaning hydrofoil/airfoil structure of claim 20 mounted on the underside of each of the hulls with the fore and aft centerline of each hydroplaning hydrofoil/airfoil structure under the longitudinal axis of each hull; propulsion means mounted on said watercraft for powering the watercraft; and means for rotating at least one structure for directional control of the watercraft.

45. The watercraft of claim 44 wherein the stern hull is positioned aft along a longitudinal centerline between the port bow hull and the starboard bow hull.

46. The watercraft of claim 44 wherein at least one pivotable wing for creating air directional control to the watercraft is mounted between the port bow hull and the starboard bow hull.

47. A hydroplaning hydrofoil/airfoil structure for planing on or through a fluid of water or air comprising: at least two foils each having a substantially planar-bottom surface, two of said surfaces intersecting along a fore and aft longitudinal bottom centerline forming a left side foil substantially planar-bottom surface and a right side foil substantially planar-bottom surface, each foil planar-bottom surface ascending transversely from said longitudinal bottom centerline to form a dihedral angle in the range of about 2° to 30° up from a transverse horizontal line and having a positive angle of attack of about 2° to 15° in the direction of motion from a horizontal longitudinal line up to said longitudinal bottom centerline, each said left and right foil substantially planar-bottom surface having a forward swept leading edge ranging from about 4° from a line perpendicular to said longitudinal bottom centerline to about 45° forward sweep, and each said left and right foil substantially planar-bottom surface having a fore foil planar-bottom section and an aft foil planar-bottom section intersecting along said fore and aft longitudinal bottom centerline, each fore foil planar-bottom section having a swept-back leading edge ranging from about 45° from a line perpendicular to said longitudinal bottom centerline to about 70° swept-back, and each aft foil planar-bottom section having a forward swept trailing edge ranging from about 10°from a line perpendicular to said longitudinal bottom centerline to about 45° forward swept.

48. The hydroplaning hydrofoil/airfoil structure of claim 47 wherein at least one substantially vertically extending fin or rudder is affixed to the underside of the structure.

49. The hydroplaning hydrofoil/airfoil structure of claim 47 wherein said structure has propulsion means affixed thereto.

50. The hydroplaning hydrofoil/airfoil structure of claim 47 wherein a hydroplaning step is affixed to the underside of the fore foil planar-bottom sections, relative to the direction of motion, along the longitudinal bottom centerline, said hydroplaning step having a wedge angle of attack in the range of about 2° to 45° down from the longitudinal bottom centerline and a dihedral angle in the range of about 4° to 52° up from a horizontal transverse line.

51. The hydroplaning hydrofoil/airfoil structure of claim 47 wherein at least one of the leading or trailing edges are curved and at least one of the edge intersections are rounded.

52. The hydroplaning hydrofoil/airfoil structure of claim 47 wherein said structure is divided vertically in half through the longitudinal centerline providing two separate structures.

53. The hydroplaning hydrofoil/airfoil structure of claim 47 wherein said structure is reversible in the longitudinal direction of motion.

54. The hydroplaning hydrofoil/airfoil structure of claim 47 wherein said structure includes means for attaching said structure to an aquatic structure or watercraft.

55. The hydroplaning hydrofoil/airfoil structure of claim 47 wherein said structure includes means for controlling the angle of attack.

56. The hydroplaning hydrofoil/airfoil structure of claim 47 wherein said structure includes means for rotating the structure for directional control.

57. The hydroplaning hydrofoil/airfoil structure of claim 47 wherein each said foil substantially planar-bottom surface forms with a foil top surface a cross section thickness whereby the foil or chord thickness between leading and trailing edge intersections creates left planing through air or buoyancy to support said structure in water.

58. The hydroplaning hydrofoil/airfoil structure of claim 57 wherein at least one substantially vertically extending air rudder or fin is affixed to the topside of said structure.

59. The hydroplaning hydrofoil/airfoil structure of claim 57 wherein each foil top surface is curved and forms with each foil substantially planar-bottom surface a cross section thickness that is substantially identical at the leading and trailing edges to the center of the chord length whereby said structure is optionally reversible in the longitudinal direction of motion.

60. The hydroplaning hydrofoil/airfoil structure of claim 57 wherein each foil top surface is curved and forms with each foil substantially planar-bottom surface a cross section thickness whereby the maximum chord thickness is forward of the center of structure length to provide a structure which moves in one direction of motion.

61. The hydroplaning hydrofoil/airfoil structure of claim 57 wherein each foil top surface is curved and forms with each foil bottom surface an elongated teardrop cross section thickness to provide a structure which moves in one direction of motion.

62. The hydroplaning hydrofoil/airfoil structure of claim 57 wherein each foil top surface is substantially parallel to each foil planar-bottom surface and forms a substantially flat plate or sheet cross section thickness whereby said structure is optionally reversible in the longitudinal direction of motion.

63. The hydroplaning hydrofoil/airfoil structure of claim 62 wherein the substantially flat plate or sheet curves up in the range of about 1° to 35° in the fore section in the direction of motion.

64. The hydroplaning hydrofoil/airfoil structure of claim 57 wherein each foil top surface is curved and each foil bottom surface is curved and forms an elongated oval cross section thickness that is substantially identical at the leading and trailing edges to the center of the chord length whereby said structure is optionally reversible in the longitudinal direction of motion.

65. The hydroplaning hydrofoil/airfoil structure of claim 57 wherein each foil top surface forms with each foil bottom surface a substantially elongated wedge cross section thickness between the leading and trailing edges whereby said structure moves in one direction of motion.

66. A hydroplaning hydrofoil/airfoil structure for planing on or through a fluid of water or air comprising: at least four foils, each having a substantially planar-bottom surface, two of said four foil substantially planar-bottom surfaces intersecting along a fore and aft longitudinal bottom centerline forming a left side foil substantially planar-bottom surface and a right side foil substantially planar-bottom surface, each foil substantially planar-bottom surface descending transversely from said fore and aft longitudinal bottom centerline to form a negative dihedral angle in the range of about 2° to 50° down from a transverse horizontal line to a lower left longitudinal bottom line intersection formed with an outer left side intersecting foil substantially planar-bottom surface and a lower right longitudinal bottom line intersection formed with an outer right side intersecting foil substantially planar-bottom surface, each outer left side and right side foil substantially planar-bottom surface ascending transversely from said lower left longitudinal bottom line intersection and said lower right longitudinal bottom line intersection to form a positive dihedral angle in the range of about 2° to 50° up from a transverse horizontal line, each of said four foil substantially planar-bottom surfaces having an angle of attack of about 2° to 15° in the direction of motion from a horizontal longitudinal line up to said fore and aft longitudinal bottom centerline, each said outer left side and outer right side foil substantially planar-bottom surface having (1) a forward swept leading edge ranging from about 2° from a line perpendicular to said lower left longitudinal bottom line intersection and said lower right longitudinal bottom line intersection to about 60° forward sweep, and (2) a fore foil planar-bottom section and an aft foil planar-bottom section intersecting along said lower left longitudinal bottom line intersection and said lower right longitudinal bottom line intersection, and each said left side and right side foil substantially planar-bottom surface intersecting along said fore and aft longitudinal bottom centerline having a fore foil planar-bottom section and an aft foil planar-bottom section intersecting along said fore and aft longitudinal bottom centerline, each fore foil planar-bottom section having a swept-back leading edge ranging from about 30° from a line perpendicular to said fore and aft longitudinal bottom centerline and said lower left and lower right longitudinal bottom line intersections to about 75° swept-back, and each aft foil planar-bottom section having a forward swept trailing edge ranging from about 5° from a line perpendicular to said fore and aft longitudinal bottom centerline and said lower left and lower right longitudinal bottom line intersections to about 60° forward swept.

67. The hydroplaning hydrofoil/airfoil structure of claim 66 wherein at least one substantially vertically extending fin or rudder is affixed to the underside of the structure.

68. The hydroplaning hydrofoil/airfoil structure of claim 66 wherein said structure has propulsion means affixed thereto.

69. The hydroplaning hydrofoil/airfoil structure of claim 66 wherein hydroplaning steps are affixed to the underside of the fore foil planar-bottom sections, relative to the direction of motion, along the lower left and right longitudinal bottom line intersections, each hydroplaning step having a wedge angle of attack in the range of about 2° to 45° down from said bottom line intersections and dihedral angles in the range of about 4° to 52° up from a horizontal transverse line.

70. The hydroplaning hydrofoil/airfoil structure of claim 66 wherein at least one of the leading or trailing edges are curved and at least one of the edge intersections are rounded.

71. The hydroplaning hydrofoil/airfoil structure of claim 66 wherein said structure is divided vertically in half through the longitudinal centerline providing two separate structures.

72. The hydroplaning hydrofoil/airfoil structure of claim 66 wherein said structure is reversible in the longitudinal direction of motion.

73. The hydroplaning hydrofoil/airfoil structure of claim 66 wherein said structure includes means for attaching said structure to an aquatic structure or watercraft.

74. The hydroplaning hydrofoil/airfoil structure of claim 66 wherein said structure includes means for controlling the angle of attack.

75. The hydroplaning hydrofoil/airfoil structure of claim 66 wherein said structure includes means for rotating the structure for directional control.

76. The hydroplaning hydrofoil/airfoil structure of claim 66 each said foil substantially planar-bottom surface forms with a foil top surface a cross section thickness whereby the foil or chord thickness between leading and trailing edge intersections creates left planing through air or buoyancy to support said structure in water.

77. The hydroplaning hydrofoil/airfoil structure of claim 76 wherein at least one substantially vertically extending air rudder or fin is affixed to the topside of said structure.

78. The hydroplaning hydrofoil/airfoil structure of claim 76 wherein each foil top surface is curved and forms with each foil substantially planar-bottom surface a cross section thickness that is substantially identical at the leading and trailing edges to the center of the chord length whereby said structure is optionally reversible in the longitudinal direction of motion.

79. The hydroplaning hydrofoil/airfoil structure of claim 76 wherein each foil top surface is curved and forms with each foil substantially planar-bottom surface a cross section thickness whereby the maximum chord thickness is forward of the center of structure length to provide a structure which moves in one direction of motion.

80. The hydroplaning hydrofoil/airfoil structure of claim 76 wherein each foil top surface is curved and forms with each foil bottom surface an elongated teardrop cross section thickness to provide a structure which moves in one direction of motion.

81. The hydroplaning hydrofoil/airfoil structure of claim 76 wherein each foil top surface is substantially parallel to each foil planar-bottom surface and forms a substantially flat plate or sheet cross section thickness whereby said structure is optionally reversible in the longitudinal direction of motion.

82. The hydroplaning hydrofoil/airfoil structure of claim 81 wherein the substantially flat plate or sheet curves up in the range of about 1° to 35° in the fore section in the direction of motion.

83. The hydroplaning hydrofoil/airfoil structure of claim 76 wherein each foil top surface is curved and each foil bottom surface is curved and forms an elongated oval cross section thickness that is substantially identical at the leading and trailing edges to the center of the chord length whereby said structure is optionally reversible in the longitudinal direction of motion.

84. The hydroplaning hydrofoil/airfoil structure of claim 76 wherein each foil top surface forms with each foil bottom surface a substantially elongated wedge cross section thickness between the leading and trailing edges whereby said structure moves in one direction of motion.

85. A hydroplaning hydrofoil/airfoil structure for planing on or through water comprising: at least two foils each having a substantially planar-bottom surface, two of said surfaces intersecting along a fore and aft longitudinal bottom centerline forming a left side foil substantially planar-bottom surface and a right side foil substantially planar-bottom surface, each foil substantially planar-bottom surface ascending transversely from said longitudinal bottom centerline to form a dihedral angle in the range of about 2° to 50° up from a transverse horizontal line and having a positive angle of attack of about 1° to 16° in the direction of motion from a horizontal longitudinal line up to said longitudinal bottom centerline, each said left and right foil substantially planar-bottom surface having a fore foil planar-bottom section having a swept-back leading edge of about 45° from a line perpendicular to said longitudinal bottom centerline and an aft foil planar-bottom section having a forward swept trailing edge of about 45° from a line perpendicular to said longitudinal bottom centerline.

86. The hydroplaning hydrofoil/airfoil structure of claim 85 wherein at least one substantially vertically extending fin or rudder is affixed to the underside of the structure.

87. The hydroplaning hydrofoil/airfoil structure of claim 85 wherein said structure has propulsion means affixed thereto.

88. The hydroplaning hydrofoil/airfoil structure of claim 85 wherein a hydroplaning step is affixed to the underside of the fore foil planar-bottom sections, relative to the direction of motion, along the longitudinal bottom centerline, said hydroplaning step having a wedge angle of attack in the range of about 2° to 45° down from the longitudinal bottom centerline and a dihedral angle in the range of about 4° to 52° up from a horizontal transverse line.

89. The hydroplaning hydrofoil/airfoil structure of claim 85 wherein at least one of the leading or trailing edges are curved and at least one of the edge intersections are rounded.

90. The hydroplaning hydrofoil/airfoil structure of claim 85 wherein said structure is divided vertically in half through the longitudinal centerline providing two separate structures.

91. The hydroplaning hydrofoil/airfoil structure of claim 85 wherein said structure is reversible in the longitudinal direction of motion.

92. The hydroplaning hydrofoil/airfoil structure of claim 85 wherein said structure includes means for attaching said structure to an aquatic structure or watercraft.

93. The hydroplaning hydrofoil/airfoil structure of claim 85 wherein said structure includes means for controlling the angle of attack.

94. The hydroplaning hydrofoil/airfoil structure of claim 85 wherein said structure includes means for rotating the structure for directional control.

95. The hydroplaning hydrofoil/airfoil structure of claim 85 wherein each said foil substantially planar-bottom surface forms with a foil top surface a cross section thickness whereby the foil or chord thickness between leading and trailing edge intersections creates buoyancy to support said structure in water.

96. The hydroplaning hydrofoil/airfoil structure of claim 95 wherein each foil top surface is curved and forms with each foil substantially planar-bottom surface a cross section thickness that is substantially identical at the leading and trailing edges to the center of the chord length whereby said structure is optionally reversible in the longitudinal direction of motion.

97. The hydroplaning hydrofoil/airfoil structure of claim 95 wherein each foil top surface is curved and forms with each foil substantially planar-bottom surface a cross section thickness whereby the maximum chord thickness is forward of the center of structure length to provide a structure which moves in one direction of motion.

98. The hydroplaning hydrofoil/airfoil structure of claim 95 wherein each foil top surface is curved and forms with each foil bottom surface an elongated teardrop cross section thickness to provide a structure which moves in one direction of motion.

99. The hydroplaning hydrofoil/airfoil structure of claim 95 wherein each foil top surface is substantially parallel to each foil planar-bottom surface and forms a substantially flat plate or sheet cross section thickness whereby said structure is optionally reversible in the longitudinal direction of motion.

100. The hydroplaning hydrofoil/airfoil structure of claim 99 wherein the substantially flat plate or sheet curves up in the range of about 1° to 35° in the fore section in the direction of motion.

101. The hydroplaning hydrofoil/airfoil structure of claim 95 wherein each foil top surface is curved and each foil bottom surface is curved and forms an elongated oval cross section thickness that is substantially identical at the leading and trailing edges to the center of the chord length whereby said structure is optionally reversible in the longitudinal direction of motion.

102. The hydroplaning hydrofoil/airfoil structure of claim 95 wherein each foil top surface forms with each foil bottom surface a substantially elongated wedge cross section thickness between the leading and trailing edges whereby said structure moves in one direction of motion.

103. A hydroplaning hydrofoil/airfoil structure for planing on or through water comprising: at least two foils each having a substantially planar-bottom surface, two of said surfaces intersecting along a fore and aft longitudinal bottom centerline forming a left side foil substantially planar-bottom surface and a right side foil substantially planar-bottom surface, each foil substantially planar-bottom surface ascending transversely from said longitudinal bottom centerline to form a dihedral angle in the range of about 2° to 50° up from a transverse horizontal line and having a positive angle of attack of about 1° to 16° in the direction of motion from a horizontal longitudinal line up to said longitudinal bottom centerline, each said left and right foil substantially planar-bottom surface having a fore foil planar-bottom section having a swept-back leading edge of about 60° from a line perpendicular to said longitudinal bottom centerline, and an aft foil planar-bottom section trailing edge extending perpendicular to or about 0° from a line perpendicular to said longitudinal bottom centerline.

104. The hydroplaning hydrofoil/airfoil structure of claim 103 wherein at least one substantially vertically extending fin or rudder is affixed to the underside of the structure.

105. The hydroplaning hydrofoil/airfoil structure of claim 103 wherein said structure has propulsion means affixed thereto.

106. The hydroplaning hydrofoil/airfoil structure of claim 103 wherein a hydroplaning step is affixed to the underside of the fore foil planar-bottom sections, relative to the direction of motion, along the longitudinal bottom centerline, said hydroplaning step having a wedge angle of attack in the range of about 2° to 45° down from the longitudinal bottom centerline and a dihedral angle in the range of about 4° to 52° up from a horizontal transverse line.

107. The hydroplaning hydrofoil/airfoil structure of claim 103 wherein at least one of the leading or trailing edges are curved and at least one of the edge intersections are rounded.

108. The hydroplaning hydrofoil/airfoil structure of claim 103 wherein said structure is divided vertically in half through the longitudinal centerline providing two separate structures.

109. The hydroplaning hydrofoil/airfoil structure of claim 103 wherein said is reversible in the longitudinal direction of motion.

110. The hydroplaning hydrofoil/airfoil structure of claim 103 wherein said st includes means for attaching said structure to an aquatic structure or watercraft.

111. The hydroplaning hydrofoil/airfoil structure of claim 103 wherein said structure includes means for controlling the angle of attack.

112. The hydroplaning hydrofoil/airfoil structure of claim 103 wherein said structure includes means for rotating the structure for directional control.

113. The hydroplaning hydrofoil/airfoil structure of claim 103 wherein each said foil substantially planar-bottom surface forms with a foil top surface a cross section thickness whereby the foil or chord thickness between leading and trailing edge intersections creates buoyancy to support said structure in water.

114. The hydroplaning hydrofoil/airfoil structure of claim 113 wherein each foil top surface is curved and forms with each foil substantially planar-bottom surface a cross section thickness that is substantially identical at the leading and trailing edges to the center of the chord length whereby said structure is optionally reversible in the longitudinal direction of motion.

115. The hydroplaning hydrofoil/airfoil structure of claim 113 wherein each foil top surface is curved and forms with each foil substantially planar-bottom surface a cross section thickness whereby the maximum chord thickness is forward of the center, of structure length to provide a structure which moves in one direction of motion.

116. The hydroplaning hydrofoil/airfoil structure of claim 113 wherein each foil top surface is curved and forms with each foil bottom surface an elongated teardrop cross section thickness to provide a structure which moves in one direction of motion.

117. The hydroplaning hydrofoil/airfoil structure of claim 113 wherein each foil top surface is substantially parallel to each foil planar-bottom surface and forms a substantially flat plate or sheet cross section thickness whereby said structure is optionally reversible in the longitudinal direction of motion.

118. The hydroplaning hydrofoil/airfoil structure of claim 117 wherein the substantially flat plate or sheet curves up in the range of about 1° to 35° in the fore section in the direction of motion.

119. The hydroplaning hydrofoil/airfoil structure of claim 113 wherein each foil top surface is curved and each foil bottom surface is curved and forms an elongated oval cross section thickness that is substantially identical at the leading and trailing edges to the center of the chord length whereby said structure is optionally reversible in the longitudinal direction of motion.

120. The hydroplaning hydrofoil/airfoil structure of claim 113 wherein each foil top surface forms with each foil bottom surface a substantially elongated wedge cross section thickness between the leading and trailing edges whereby said structure moves in one direction of motion.

121. A hydroplaning hydrofoil/airfoil structure for planing on or through water comprising: at least two foils each having a substantially planar-bottom surface, two of said surfaces intersecting along a fore and aft longitudinal bottom centerline forming a left side foil substantially planar-bottom surface and a right side foil substantially planar-bottom surface, each foil planar-bottom surface ascending transversely from said longitudinal bottom centerline to form a dihedral angle in the range of about 2° to 50° up from a transverse horizontal line and having a positive angle of attack of about 1° to 16° in the direction of motion from a horizontal longitudinal line up to said longitudinal bottom centerline, each said left and right foil substantially planar-bottom surface having a fore foil planar-bottom section having a swept-back leading edge of about 60° from a line perpendicular to said longitudinal bottom centerline, and an aft foil planar-bottom section having a swept-back trailing edge of about 30° from a line perpendicular to said longitudinal bottom centerline.

122. The hydroplaning hydrofoil/airfoil structure of claim 121 wherein at least one substantially vertically extending fin or rudder is affixed to the underside of the structure.

123. The hydroplaning hydrofoil/airfoil structure of claim 121 wherein said structure has propulsion means affixed thereto.

124. The hydroplaning hydrofoil/airfoil structure of claim 121 wherein a hydroplaning step is affixed to the underside of the fore foil planar-bottom sections, relative to the direction of motion, along the longitudinal bottom centerline, said hydroplaning step having a wedge angle of attack in the range of about 2° to 45° down from the longitudinal bottom centerline and a dihedral angle in the range of about 4° to 52° up from a horizontal transverse line.

125. The hydroplaning hydrofoil/airfoil structure of claim 121 wherein at least one of the leading or trailing edges are curved and at least one of the edge intersections are rounded.

126. The hydroplaning hydrofoil/airfoil structure of claim 121 wherein said structure is divided vertically in half through the longitudinal centerline providing two separate structures.

127. The hydroplaning hydrofoil/airfoil structure of claim 121 wherein said structure is reversible in the longitudinal direction of motion.

128. The hydroplaning hydrofoil/airfoil structure of claim 121 wherein said structure includes means for attaching said structure to an aquatic structure or watercraft.

129. The hydroplaning hydrofoil/airfoil structure of claim 121 wherein said structure includes means for controlling the angle of attack.

130. The hydroplaning hydrofoil/airfoil structure of claim 121 wherein said structure includes means for rotating the structure for directional control.

131. The hydroplaning hydrofoil/airfoil structure of claim 121 wherein each said foil substantially planar-bottom surface forms with a foil top surface a cross section thickness whereby the foil or chord thickness between leading and trailing edge intersections creates buoyancy to support said structure in water.

132. The hydroplaning hydrofoil/airfoil structure of claim 131 wherein each foil top surface is curved and forms with each foil substantially planar-bottom surface a cross section thickness that is substantially identical at the leading and trailing edges to the center of the chord length whereby said structure is optionally reversible in the longitudinal direction of motion.

133. The hydroplaning hydrofoil/airfoil structure of claim 131 wherein each foil top surface is curved and forms with each foil substantially planar-bottom surface a cross section thickness whereby the maximum chord thickness is forward of the center of structure length to provide a structure which moves in one direction of motion.

134. The hydroplaning hydrofoil/airfoil structure of claim 131 wherein each foil top surface is curved and forms with each foil bottom surface an elongated teardrop cross section thickness to provide a structure which moves in one direction of motion.

135. The hydroplaning hydrofoil/airfoil structure of claim 131 wherein each foil top surface is substantially parallel to each foil planar-bottom surface and forms a substantially flat plate or sheet cross section thickness whereby said structure is optionally reversible in the longitudinal direction of motion.

136. The hydroplaning hydrofoil/airfoil structure of claim 135 wherein the substantially flat plate or sheet curves up in the range of about 1° to 35° in the fore section in the direction of motion.

137. The hydroplaning hydrofoil/airfoil structure of claim 131 wherein each foil top surface is curved and each foil bottom surface is curved and forms an elongated oval cross section thickness that is substantially identical at the leading and trailing edges to the center of the chord length whereby said structure is optionally reversible in the longitudinal direction of motion.

138. The hydroplaning hydrofoil/airfoil structure of claim 131 wherein each foil top surface forms with each foil bottom surface a substantially elongated wedge cross section thickness between the leading and trailing edges whereby said structure moves in one direction of motion.

139. An aquatic structure or watercraft comprising: a port bow hull, a starboard bow hull, and a stern hull positioned aft along a longitudinal centerline between the port bow hull and the starboard bow hull; at least one crossbeam connector rigidly affixed to the port and starboard bow hulls; at least one fore and aft extending port connector and at least one fore and aft extending starboard connector, such connectors rigidly affixed to the stern hull and to the port and starboard bow hulls; propulsion means mounted on said structure for powering the structure; means for controlling the direction of movement of the structure; and supporting means attached to the underside of each full for supporting and moving the structure over water.

140. The watercraft of claim 139 wherein the supporting means are removably attached to each hull.

141. The watercraft of claim 139 wherein the supporting means are the undersides of the hulls.

142. The watercraft of claim 139 wherein the propulsion means is a sailing rig.

143. The watercraft of claim 139 wherein at least one pivotable wing for creating air directional control to the structure is mounted on at least one crossbeam connector.

144. The watercraft of claim 139 wherein the supporting means are strut-mounted hydroplaning hydrofoil/airfoil structures, each being a structure which comprises at least two foils each having a substantially planar-bottom surface, two of said surfaces intersecting along a fore and aft longitudinal bottom centerline forming a left side foil substantially planar-bottom surface and a right side foil substantially planar-bottom surface, each foil planar-bottom surface ascending transversely from said longitudinal bottom centerline to form a dihedral angle in the range of about 2° to 50° up from a transverse horizontal line and having a positive angle of attack of about 2° to 15° in the direction of motion from a horizontal longitudinal line up to said longitudinal bottom centerline, each said left and right foil substantially planar-bottom surface having a forward swept leading edge ranging from about 2° from a line perpendicular to said longitudinal bottom centerline to about 60° forward sweep, and each said left and right foil substantially planar-bottom surface having a fore foil planar-bottom section and an aft foil planar-bottom section intersecting along said fore and aft longitudinal bottom centerline, each fore foil planar-bottom section having a swept-back leading edge ranging from about 30° from a line perpendicular to said longitudinal bottom centerline to about 75° swept-back, and each aft foil planar-bottom section having a forward swept trailing edge ranging from about 5° from a line perpendicular to said longitudinal bottom centerline to about 60° forward swept.

145. The watercraft of claim 144 wherein the fore and aft port and starboard connectors extend forward angled out from the stern hull to a point in front of at least one crossbeam connector; and the propulsion means is a sailing rig having forestays connected to the fore and aft port and starboard connectors at a point in front of the most forward crossbeam connector.

146. The watercraft of claim 145 wherein at least one pivotable wing for creating air directional control to the watercraft is mounted on at least one crossbeam connector.

147. The watercraft of claim 145 wherein a traveler connector is removably mounted across the fore and aft port and starboard connectors between at least one crossbeam connector and the stern hull section.

148. The watercraft of claim 145 wherein at least one crossbeam connector connecting the port bow hull and the starboard bow hull is arched or angled up slightly from said hulls to a high point at the longitudinal centerline.

149. The watercraft of claim 145 wherein the fore and aft port and starboard connectors are angled forward and out horizontally from the stern hull longitudinal centerline, each at an angle of about 0° to 45°.

150. The watercraft of claim 145 wherein a mast step tube or brace is mounted between at least two port and starboard crossbeam connectors along the longitudinal centerline.

* * * * *

UNITED STATES PATENT AND TRADEMARK OFFICE

CERTIFICATE OF CORRECTION

PATENT NO. : 5,136,961
DATED : August 11, 1992
INVENTOR(S) : Harold Eugene Follett It is certified that error appears in the above-indentified patent and that said Letters Patent is hereby corrected as shown below:

In Column 8, line 54, "and 89" should read --and 86--.

In Column 27, line 45, "from about 20°" should read --from about 2°--.

In Column 27, line 56, "from about 50°" should read --from about 5°--.

In Column 28, line 41, "surface is covered" should read --surface is curved--.

In Column 34, line 43, after "claim 66" insert --wherein--.

In Column 37, line 45, after "wherein said" insert --structure--.

In Column 37, line 48, after "wherein said" delete "st" and insert --structure--.

In Column 40, line 17, after "of each" delete "full" and insert --hull--.

Signed and Sealed this

Eighth Day of March, 1994

Bruce Lehman

*Attest:*

BRUCE LEHMAN

*Attesting Officer*

*Commissioner of Patents and Trademarks*